US010821043B2

(12) United States Patent
Coppens et al.

(10) Patent No.: US 10,821,043 B2
(45) Date of Patent: Nov. 3, 2020

(54) PATIENT TRANSFER DEVICE AND ASSOCIATED SYSTEMS AND METHODS

(71) Applicant: QFIX SYSTEMS, LLC, Avondale, PA (US)

(72) Inventors: Daniel D. Coppens, Avondale, PA (US); David M. Rabeno, Avondale, PA (US); Richard Herrschaft, West Chester, PA (US); Zachary Knezo, Coatesville, PA (US); John Capone, West Chester, PA (US); Sean McGrenaghan, West Chester, PA (US)

(73) Assignee: Qfix Systems, LLC, Avondale, PA (US)

( * ) Notice: Subject to any disclaimer, the term of this patent is extended or adjusted under 35 U.S.C. 154(b) by 361 days.

(21) Appl. No.: 15/526,564

(22) PCT Filed: Nov. 13, 2015

(86) PCT No.: PCT/US2015/060503
§ 371 (c)(1),
(2) Date: May 12, 2017

(87) PCT Pub. No.: WO2016/077658
PCT Pub. Date: May 19, 2016

(65) Prior Publication Data

US 2017/0312156 A1 Nov. 2, 2017

Related U.S. Application Data

(60) Provisional application No. 62/241,396, filed on Oct. 14, 2015, provisional application No. 62/079,913, filed on Nov. 14, 2014.

(51) Int. Cl.
*A61G 7/10* (2006.01)

(52) U.S. Cl.
CPC ..... *A61G 7/1028* (2013.01); *A61G 7/1026* (2013.01); *A61G 2200/327* (2013.01)

(58) Field of Classification Search
CPC ..... A61G 7/1028; A61G 7/1026; A61G 2200/327
See application file for complete search history.

(56) References Cited

U.S. PATENT DOCUMENTS 4,528,704 A * 7/1985 Wegener ..... B65G 7/06 180/125
5,065,464 A * 11/1991 Blanchard ..... A61G 7/1028 180/125
5,067,189 A * 11/1991 Weedling ..... A61G 7/1028 180/125

(Continued)

FOREIGN PATENT DOCUMENTS

CN 101686892 A 3/2010
WO 2016014695 A2 1/2016

OTHER PUBLICATIONS

International Search Report and Written Opinion for International Application No. PCT/US2015/060503, dated May 10, 2016—14 Pages.

(Continued)

*Primary Examiner* — Robert G Santos
*Assistant Examiner* — Rahib T Zaman
(74) *Attorney, Agent, or Firm* — RatnerPrestia

(57) ABSTRACT

A patient transfer device includes a patient support surface having a top surface adapted for positioning a patient thereon and a bottom surface defining one or more areas having a concave curvature for passage of air flow therethrough. Passage of the air flow along the one or more areas having a concave curvature provides an air bearing below at least a portion of the bottom surface. Exemplary patient transfer systems and methods of moving a patient are also provided.

14 Claims, 32 Drawing Sheets

(56) References Cited

U.S. PATENT DOCUMENTS

| | | | | |
|---|---|---|---|---|
| 5,561,873 | A * | 10/1996 | Weedling | A61G 7/1028 5/703 |
| 6,467,106 | B1 * | 10/2002 | Heimbrock | A61G 7/1026 5/654 |
| 7,712,170 | B2 * | 5/2010 | Davis | A61G 1/013 5/711 |
| 7,739,758 | B2 * | 6/2010 | Weedling | A61G 7/103 5/81.1 HS |
| 8,011,039 | B2 | 9/2011 | Stryker et al. | |
| 8,234,727 | B2 * | 8/2012 | Schreiber | A61G 7/1028 5/703 |
| 2010/0071127 | A1 * | 3/2010 | Koger | A61G 7/103 5/81.1 HS |
| 2012/0304384 | A1 * | 12/2012 | Scholz | A61G 7/1025 5/600 |
| 2013/0145549 | A1 * | 6/2013 | Piegdon | A61G 7/00 5/600 |
| 2013/0212806 | A1 * | 8/2013 | Coppens | A47C 31/023 5/601 |
| 2014/0143950 | A1 | 5/2014 | Koger et al. | |

OTHER PUBLICATIONS

International Preliminary Report on Patentability for International Application No. PCT/US2015/060503, dated May 16, 2016—10 Pages.

Chinese Office Action for Chinese Application No. 201580073337.8, dated May 22, 2019 with translation, 34 pages.

Chinese Office Action for Chinese Application No. 201580073337.8, dated Apr. 14, 2020 with translation, 33 pages.

* cited by examiner

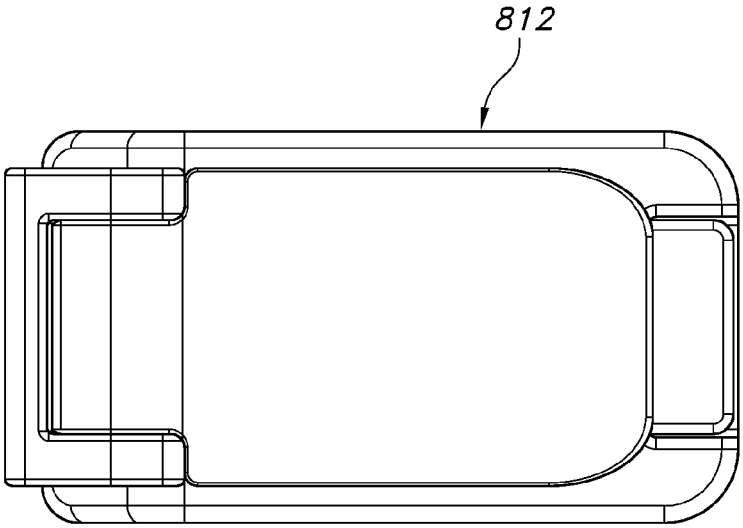
FIG. 29
FIG. 30
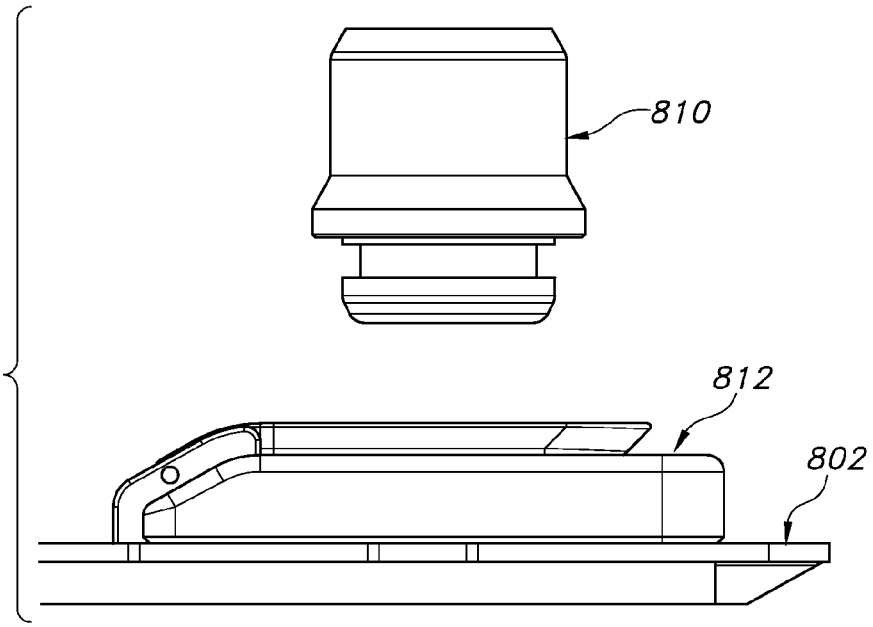

PATIENT TRANSFER DEVICE AND ASSOCIATED SYSTEMS AND METHODS

CROSS-REFERENCE TO RELATED APPLICATIONS

This application is a U.S. national phase application of PCT International Application PCT/US2015/060503, which was filed on Nov. 13, 2015, and claims the benefit of U.S. provisional patent application entitled "PATIENT TRANSFER DEVICE AND ASSOCIATED SYSTEMS AND METHODS," which was filed on Nov. 14, 2014 and assigned Ser. No. 62/079,913, and U.S. provisional patent application with the same title filed on Oct. 14, 2015 and assigned Ser. No. 62/241,396. The entire contents of the foregoing applications are incorporated herein by reference.

TECHNICAL FIELD

The present invention generally relates to patient transfer devices for transferring a patient between modalities and associated systems and methods and, in particular, to patient transfer devices which define substantially homogenous structures and provide safe transport of patients during medical procedures.

BACKGROUND OF THE INVENTION

Radiation therapy and diagnostic imaging equipment are used frequently in hospitals and treatment centers. Modern techniques for radiation therapy and diagnostic imaging typically require that patients be positioned and immobilized in a precise orientation to ensure accurate imaging and treatment. In particular, treatment of a tumor by radiation therapy is generally preceded by a diagnostic imaging procedure referred to as simulation. During simulation, the patient is positioned in the manner anticipated for treatment. The manner anticipated for treatment includes the physical orientation of the patient using the positioning and immobilization devices that will be used during the treatment.

Once the physical orientation of the patient for treatment has been determined, the diagnostic imaging procedure can be used to collect a computer data set of the patient (DICOM) which contains an accurate representation of the location of the tumor to be treated. The DICOM can be imported into treatment planning software (TPS) such that the treatment can be modeled and planned.

To ensure accurate tumor location identification for treatment, it is critical in such applications that the patient be situated in the same position and orientation on the same devices or supports during treatment of the patient. The patient positioning and immobilization process in preparation for use of the treatment or imaging equipment can be extensive and time consuming. Therefore, to better utilize the time on the treatment or imaging equipment, it can generally be beneficial to position and immobilize the patient on a device or support other than the treatment or imaging equipment. In some cases, the diagnostic imaging during simulation and the subsequent treatment are performed on the same day. In these cases, it can be beneficial to position and immobilize the patient on the device or support once and keep the patient immobilized throughout the two procedures.

Thus, a need exists for patient transfer devices which define substantially homogenous structures and provide safe transport of patients during the wide variety of medical procedures conducted. Examples of these procedures include radiation therapy, brachytherapy, operating room procedures, emergency medical services, etc. These and other needs are addressed by the patient transfer devices and associated systems and methods of the present invention.

SUMMARY OF THE INVENTION

Aspects of the invention include patient transfer devices for transferring a patient between modalities. The patient transfer devices include a top surface configured to support the patient, a bottom surface configured to face a support surface of at least one of the modalities and an integrally sculpted configuration defined by the bottom surface. Passage of air flow below the bottom surface of the patient transfer device and the integrally sculpted configuration defined by the bottom surface creates an air bearing under the patient transfer device. The air bearing reduces friction between the patient transfer device and the support surface of the at least one of the modalities, thereby facilitating transport of the patient transfer device between modalities when supporting the patient on the top surface of the patient transfer device.

Further aspects of the invention include patient transfer systems for transferring a patient between modalities. Typical modalities may include linear accelerators, proton therapy machines, brachytherapy systems, CT, MRI, PET, as examples. The systems may include a patient transfer device with a top surface configured to support a patient thereon, a bottom surface, and an integrally sculpted configuration defined by the bottom surface. The systems may further include an air source for providing air flow below the bottom surface of the patient transfer device and the integrally sculpted configuration of the patient transfer device. The passage of air flow below the bottom surface and the integrally sculpted configuration creates an air bearing under the patient transfer device that permits reduced friction transport of the patient transfer device between modalities when supporting the patient on the top surface of the patient transfer device.

Aspects of the invention further include a method of producing a patient transfer system. The method includes configuring a top surface of a patient transfer device to support a patient thereon, defining an integrally sculpted configuration by a bottom surface of the patient transfer device, and coupling an air source to the patient transfer device. The air source being configured to pass air flow below the bottom surface of the patient transfer device, thereby creating an air bearing permitting reduced friction transport of the patient transfer device between modalities when supporting the patient on the top surface.

Additional aspects of the invention include a patient transfer device for transferring a patient between modalities. The device includes a top surface configured to support the patient thereon and a bottom surface configured to face a support surface of at least one of the modalities. The bottom surface may define at least one recess extending along the bottom surface of the patient transfer device. Passage of air flow below the bottom surface of the patient transfer device and within the at least one recess defined by the bottom surface creates an air bearing under the patient transfer device, the air bearing reducing friction between the patient transfer device and the support surface of the at least one of the modalities, thereby facilitating transport of the patient transfer device between modalities when supporting the patient on the top surface of the patient transfer device.

In accordance with embodiments of the present invention, exemplary patient transfer devices are provided that include a top surface and a bottom surface. The top surface can be adapted for positioning of a patient thereon. The bottom surface includes at least one integrally sculpted or formed section for passage of air flow therethrough. Passage of the air flow along the at least one integrally sculpted section can create an air bearing below at least a portion of the bottom surface for moving the patient on the patient transfer device.

In some embodiments, at least a portion of the top surface can define a concave form. The at least one integrally sculpted section can extend in a longitudinal direction along at least a portion of the bottom surface. In some embodiments, the at least one integrally sculpted section can include two sections of different configurations for passage of the air flow therethrough. In some embodiments, the at least one integrally sculpted section can at least partially extend adjacent to a perimeter of the bottom surface. In such embodiments, the patient transfer devices can include a central section devoid of the air flow.

In some embodiments, the at least one integrally sculpted section may include multiple sections having similar or different configurations for passage of the air flow therethrough. The multiple sections may be fluidly connected to each other.

The top surface and the bottom surface can be fabricated from a rigid material. The patient transfer devices further include a cover positioned across the bottom surface to create a cavity between the bottom surface and the cover through which the air flow passes. The cover can include one or more perforated regions and one or more unperforated regions. The air flow passing out of the one or more perforated regions can create the air bearing below at least a portion of the bottom surface. The cover can be fabricated from at least one of a rigid material, a flexible material, a fabric material, or combinations thereof. In some embodiments, the cover can be permanently secured to the bottom surface. In some embodiments, the cover can be detachably secured to the bottom surface.

In some embodiments, the patient transfer devices can include a cover positioned across the bottom surface and an internal cover positioned along the bottom surface between the bottom surface and the cover. The cover and the internal cover can create a cavity between the cover and the internal cover through which the air flow passes. When both covers are flexible, this may form a bladder.

In accordance with embodiments of the present invention, exemplary patient transfer systems are provided that include a patient transfer device as described herein. The patient transfer systems include an air source for providing the air flow to the at least one integrally sculpted section of the patient transfer device. In some embodiments, the air source can be disposed within the patient transfer device. In some embodiments, the air source can be external to the patient transfer device.

In accordance with embodiments of the present invention, exemplary methods of moving a patient are provided that include introducing air flow to a patient transfer device as described herein. Passage of the air flow through the at least one integrally sculpted section can create an air bearing below at least a portion of the bottom surface for moving the patient on the patient transfer device.

Other objects and features will become apparent from the following detailed description considered in conjunction with the accompanying drawings. It is to be understood, however, that the drawings are designed as an illustration only and not as a definition of the limits of the invention.

BRIEF DESCRIPTION OF THE DRAWINGS

To assist those of skill in the art in making and using the disclosed patient transfer devices and associated systems methods, reference is made to the accompanying figures, wherein:

FIG. 29 is a top view of a valve cover component of the patient transfer device illustrated in FIG. 27.

FIG. 30 is a side view of a valve and mounting portion of an air supply hose.

DESCRIPTION OF EXEMPLARY EMBODIMENTS OF THE INVENTION

When transporting patients from one piece of equipment to another (e.g., between modalities) during a medical procedure or between simulation and treatment, it is desirable to employ a low, or reduced, friction transfer device or system. As used herein, "low" or "reduced" friction will be understood by those of ordinary skill in the art to mean friction that is lowered or reduced by application of air bearings below patient transfer devices as compared to friction without application of the air bearings. Low friction transfer devices enable the safe transfer of a patient from one target modality to another.

Figure 42A:
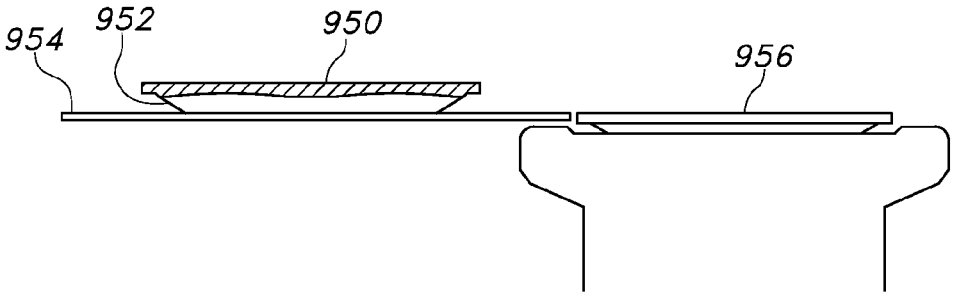
FIGS. 42(*a*)-42(*c*) are a front cross-sectional view of the various stages of an exemplary method of moving a patient transfer device according to the present invention.
Figure 42B:
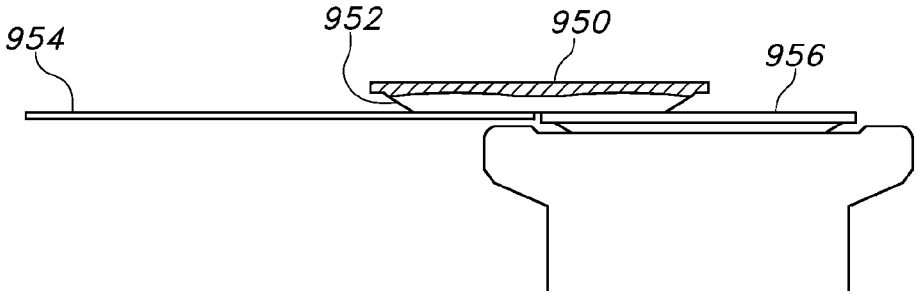
Figure 42C:
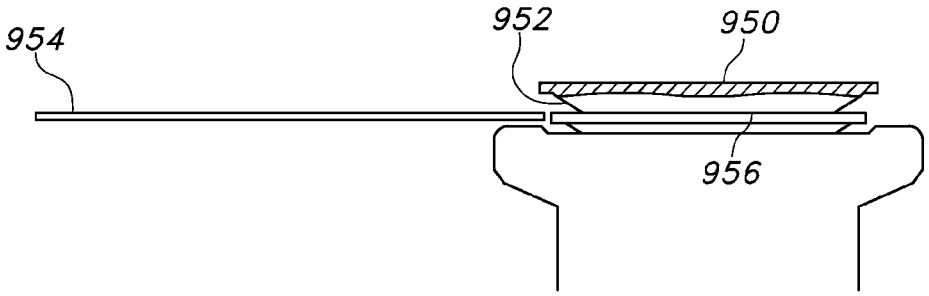

For example, referring to FIGS. 42(*a*) to 42(*c*), the various stages of an exemplary method of moving a patient transfer device according to the present invention is provided. In FIG. 42(*a*) a patient transfer device 950 is located on the top surface of a transport device 954, such as a patient trolley. The transport device 954 is maneuvered such that the top surface of the transport device 954 is adjacent to and at a similar elevation as the top surface of a target modality 956, such as an MRI table. An air bearing 952 located underneath the top patient supporting surface of the patient transfer device 950 is inflated, thereby reducing the friction as it slides the transport device 954 to the target modality 956, as illustrated in FIG. 42(*b*) and FIG. 42(*c*).

By placing an air bearing between a patient supporting surface and a treatment device supporting structure (e.g. a computerized tomography (CT) couch, a linear accelerator couch, a trolley, or the like), the patient can be moved during a medical procedure, such as a CT, MRI, or PET scan, radiation therapy, brachytherapy, operating room procedures, emergency medical services, etc., in an easy and safe manner for both the patient and the operator moving the patient.

It can be disadvantageous, however, to raise a patient supporting surface too high with an air bearing, to use air bearings that are too thick, or to use air bearing devices that are not uniformly radiolucent due to the use of tubing and pockets, or both. By using air bearing devices that take up too much height, the patient access to treatment machines can be limited. As a further example, if air bearing devices can jostle the patient, they can cause inaccuracies to occur in the position of the patient. In addition, some air bearing devices can be unstable, causing the air bearing device to be unsafe and uncomfortable for the patient.

The non-uniform radiolucent properties of some air bearing devices can cause additional problems. For example, a lack of uniformity or homogeneity under X-ray results in X-ray artifacting when images are taken of the patient. A lack of uniformity can also hinder or make it impossible to treat the patient through the support system with high energy X-radiation (such as linear accelerators) or particle beam radiation (such as proton therapy). In particular, extremely low attenuation and homogeneity is desired for transport systems to effectively provide treatment.

The patient transfer devices according to the present invention may be used in a wide variety of applications to facilitate the movement of a living being, such as by transfer of a patient. It will be appreciated by one of skill in the art that transfer devices according to aspects of this invention can be utilized in the many applications described herein as well as other applications.

For example, the devices according to the present invention may be used individuals in the field to assist the support or movement of living beings, such as for example by emergency responders to retrieve a patient involved in an accident. Such assistance may be desirable in connection with sporting injuries, automobile accidents, home injuries, or other instances in which support, transfer, or transportation of a living being may be needed or desired.

Upon arriving at a hospital or other medical treatment center or destination, the patient transfer devices may be used to transfer the injured patient to a target modality. For example, a patient may be transferred among mobile or fixed surfaces for treatment, diagnosis, rest or rehabilitation.

Patients are not limited to human patients. The patient transfer devices according to the present invention may also be used for veterinary medical applications for animals requiring transfer among or between diagnostic tests, laboratory analyses, and therapeutic procedures, including, but not limited to surgery.

The present invention is directed to exemplary patient transfer devices and associated systems and methods which provide a low or reduced friction transfer of the patient between modalities. The low friction of the patient transfer devices can be compatible with a variety of imaging and treatment modalities. For example, the patient transfer devices can be used for radiation treatment and diagnostic imaging equipment. By using the same patient transfer device during preparation and treatment of the patient, hospitals and treatment centers can have better utilization of equipment and higher patient throughput which, in turn, lowers costs and provides faster patient care.

The patient transfer devices, systems, and methods discussed herein are designed for positioning, transportation, and treatment of patients for a variety of medical procedures, e.g., radiation therapy, diagnostic imaging, or the like. For example, the patient transfer devices can be used for moving positioned or immobilized patients via a low friction interface to allow transfer of the patient from a trolley to a variety of target modalities.

In particular, the patient transfer devices provide a low friction interface comprised of an air bearing that is thin, presents low attenuation to radiation, and has homogeneous attenuation. It is preferred that patient transfer device according to the present invention exhibit a low WET (water equivalent thickness) value for low attenuation to radiation for imaging and treatment. For example, in a preferred embodiment, the patient transfer device may have a WET value that is less than 15 mm at 6 mV photons.

The various embodiments of the patient transfers devices according to the present invention also preferably exhibit little to no artifacting for x-ray usage, in other words, maximum X-ray translucency. The substantial reduction or elimination of X-ray artifacts allows the patient transfer device to act as a combination of a patient bearing device and a patient transfer device and can be compatible with a variety of diagnostic imaging and treatment modalities. In some embodiments, the patient transfer device can be constructed from materials that are compatible with a variety of medical equipment, e.g., magnetic resonance imaging (MRI) machines, and the like. In some embodiments, the air bearing can be detachable from the bottom surface of the patient transport device such that the air bearing can be easily replaced due to wear, contamination, or other reasons. When attached to the bottom surface of the homogeneous patient transfer device that is radiolucent, non-artifacting, and MRI or proton therapy compatible, the air bearing design does not compromise these features, thereby permitting accurate treatment of the patient.

It is an aspect of the present invention to provide a patient transfer device that enables air distribution under a bottom surface of the device to facilitate the formation of an air bearing. It is preferred that the patient transfer devices according to the present invention comprise a rigid structure upon which the patient rests for accurate patient positioning when the air bearing is inactive. The weight of a patient on top of a rigid patient transfer device, however, has the potential to depress the transfer device against the supporting surface upon which it rests and may block or inhibit the flow of air under the bottom surface of the patient transfer device. In other words, the flow of air may be inadvertently "pinched off" in such a way as to inhibit or prevent air flow to at least some locations beneath the bottom surface of the device. As a result, it may be difficult or impossible to generate an air bearing because the air pressure delivered underneath the bottom surface of the patient transfer device is unable to overcome the pressure exerted by the weight of the patient at particular points. In order to facilitate the flow of air, it is an aspect of the present invention to provide one or more air passageways that are either defined or otherwise located underneath the bottom surface of the patient transfer device.

In an embodiment of the present invention, the air passageways may be defined by the bottom surface of the patient transfer device. For example, the air passageways may be provided in the form of a contoured feature, a sculpted surface, a recess, a groove, or another surface that at least partially defines a passageway associated with the bottom surface. In other embodiments, the air passageways may be provided by using one or more spacers to define a space or gap between the bottom surface of the device and the support surface on which it rests. For example, one or more spacers can be positioned about the periphery of the bottom surface of the patient transfer device or at one or more locations of the bottom surface of the patient transfer device. The spacers may be in the form of contours, feet, pegs, or any other structure capable of maintaining a space between at least a portion of the bottom surface of the patient transfer device and a surface on which it rests.

The bottom surface of the various embodiments of the patient transfer device according to the present invention may then be covered with either a rigid or flexible cover having one or more apertures, such that when air is delivered between the bottom surface of the patient transfer device and the cover, an air bearing is formed.

In preferred embodiments of the invention, two covers or layers may be provided under the bottom surface of the patient transfer device, wherein the bottom layer is perforated and the two layers are sealed to each other at least around their peripheries to form a bladder. Delivering air to the bladder will expand the bladder and provide an air bearing. The use of a bladder is preferred because the lift provided by a bladder may facilitate transfer over a lip if the heights of the modalities differ. In other words, the expansion of the bladder raises the patient support component of the patient transfer device to an elevation above such a lip, thereby reducing or eliminating any interference as the patient transfer device is slid from one surface or modality to another. Additionally, a bladder may also be releasably attached to the patient support component of the patient transfer device such that it can be easily removable to allow for easy repair, replacement, cleaning, and/or disposal. The use of a bladder also provides the option to incorporate an air inlet or valve either in the top surface of the patient transfer device (e.g., passing into and/or through the patient support component of the patient transfer device) or directly in the bladder such as in a location that extends to a location outside the perimeter edge of the top surface of the patient transfer device.

Figure 1:
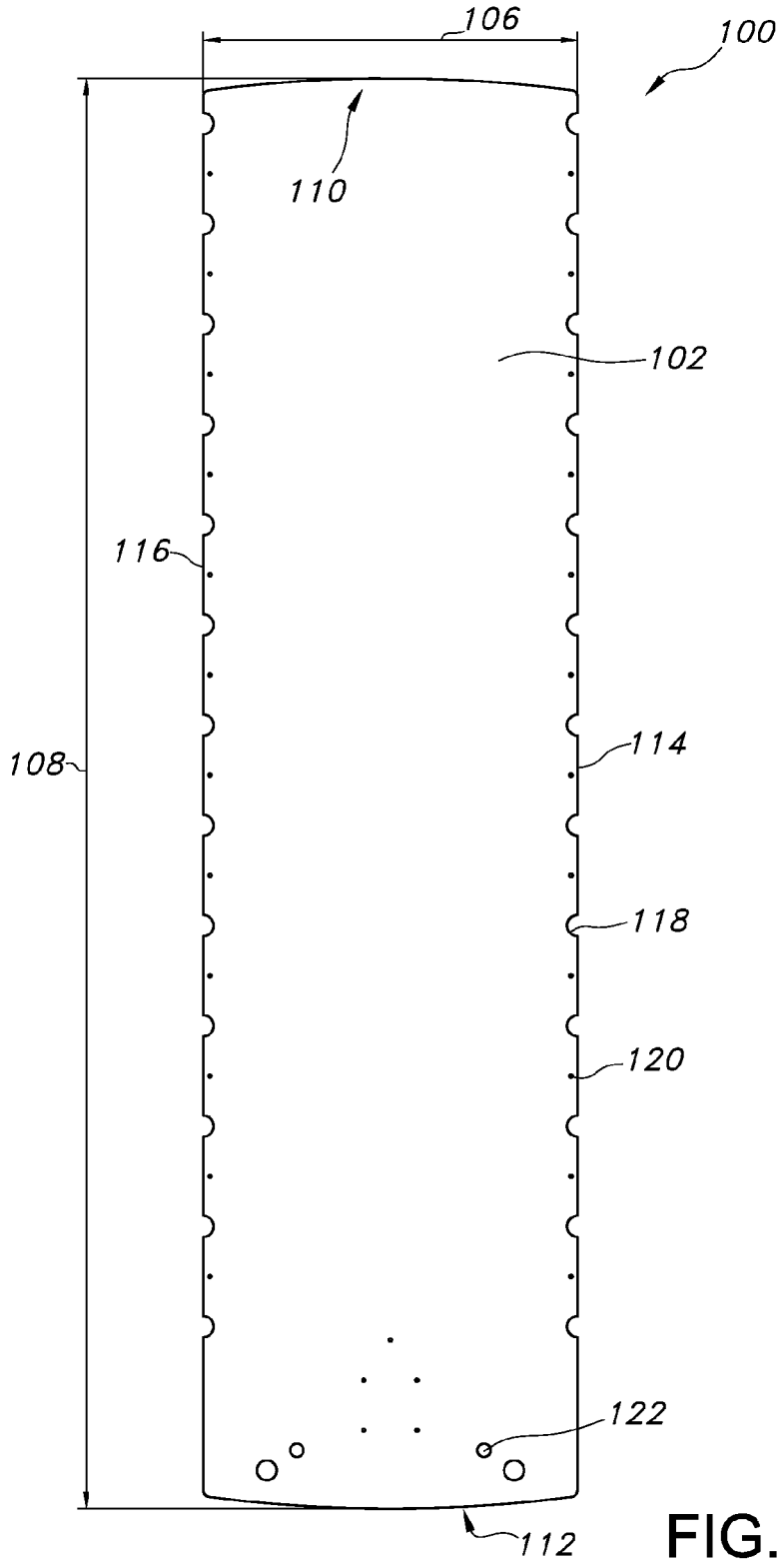
FIG. 1 is a top view of an exemplary patient transfer device according to the present invention.
Figure 2:
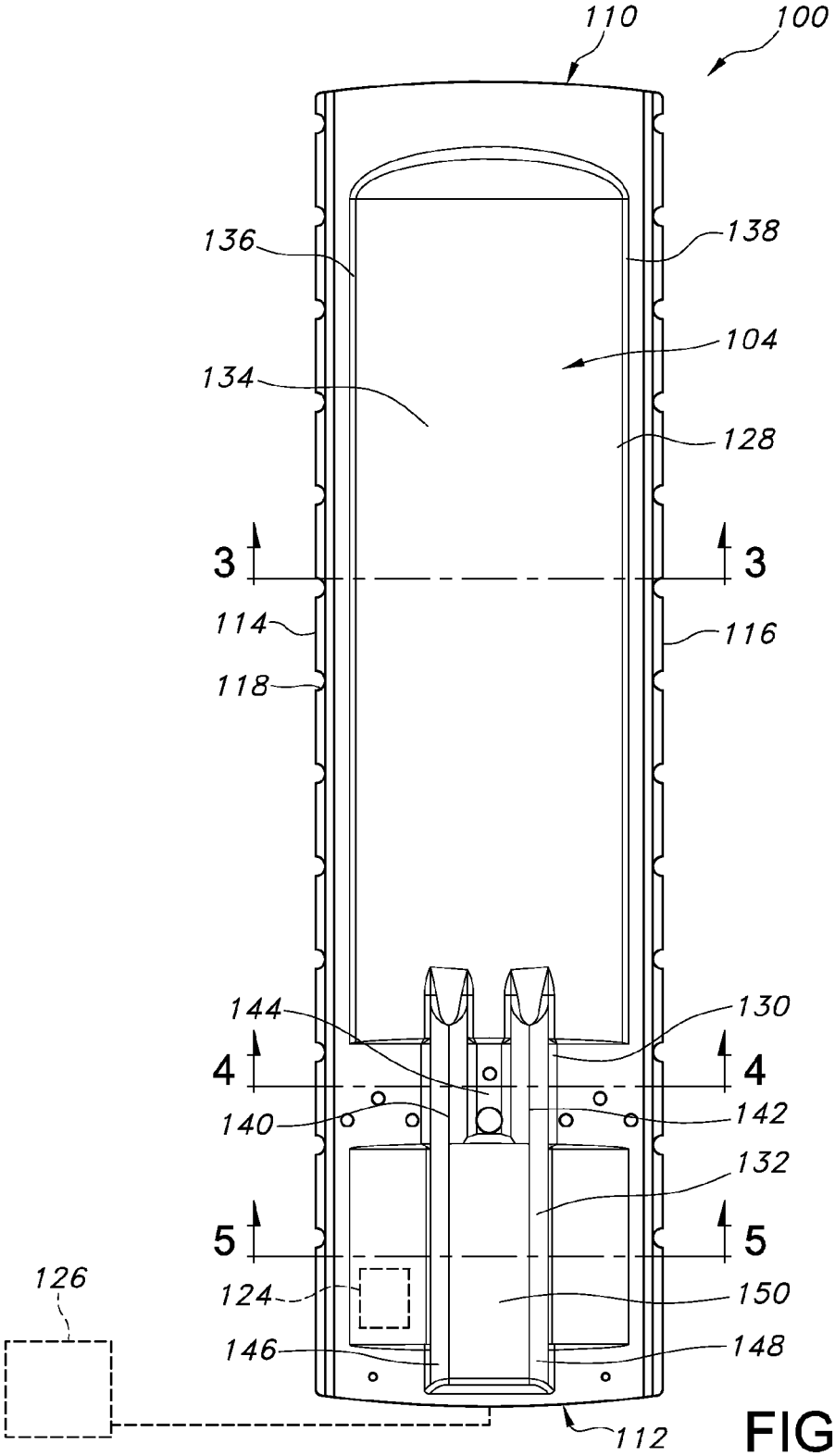
FIG. 2 is a bottom view of an exemplary patient transfer device of FIG. 1.

With reference to FIGS. 1 and 2, top and bottom views of an exemplary patient transfer device 100 are provided. In particular, FIG. 1 shows a top surface 102 of the patient transfer device 100 that is configured to support a patient thereon and FIG. 2 shows a bottom surface 104 of the patient transfer device 100 that may be configured to face a support surface of a modality (not shown). The patient transfer device 100 can be fabricated from one or more of a variety of materials, such as carbon fiber, non-conductive fibers, fiberglass, polymer(s), or the like. In some embodiments, the patient transfer device 100 can be fabricated of a composite structure including one or more rigid outer skins or surfaces separated by an internal foam or honeycomb core. For example, an internal foam or honeycomb core can reduce the weight of the patient transfer device 100 while maintaining the structural stability of the patient transfer device 100. In some embodiments, the patient transfer device 100 can include a structural, low-density foam with thin composite skins or outer surfaces surrounding the foam. The patient transfer device 100 can therefore define a substantially rigid structure. This configuration can minimize the amount of attenuation of a radiation treatment beam caused by the patient treatment device 100.

With reference to FIG. 1, the top surface 102 of the patient transfer device 100 can define a width 106 and a length 108 dimensioned to support a patient thereon. In some embodiments, the top surface 102 can define a substantially planar surface on which the patient can be positioned. In some embodiments, the top surface 102 can define a curved, concave surface configured to receive the patient thereon. For example, the top surface 102 can include a downwardly curved surface spaced from the edges of the patient transfer device 100 configured in the shape of the human body such that excessive motion of the patient on the patient transfer device 100 can be reduced. Although illustrated as defining a substantially rectangular configuration, in some embodiments, the patient transfer device 100 can define alternative configurations.

The patient transfer device 100 includes a first end 110, e.g., a proximal end, and a second end 112, e.g., a distal end. The patient transfer device 100 can be configured such that the head of a patient is positioned at or near the first end 110 and the feet of the patient extend in the direction of the second end 112. The patient transfer device 100 further includes side edges 114, 116 which extend lengthwise between the first and second ends 110, 112. In some embodiments, the side edges 114, 116, the first and second ends 110, 112, or both, can include handles for gripping and handling the patient transfer device 100.

In some embodiments, the one or both of the side edges 114, 116 include grooves 118 formed therein to assist in securing or immobilizing the patient with, e.g., straps, relative to the patient transfer device 100. In some embodiments, the patient transfer device 100 can include indexing means, e.g., marks or dimensions 120, openings or holes 122, combinations thereof, or the like, for indexing the patient to the patient transfer device 100. The openings or holes 122 can be of a variety of sizes and allow the patient to be secured to the patient transfer device 100. For example, the openings or holes 122 can be configured to receive securing means therein for securing straps holding the patient. The indexing means thereby allow for accurate and repeatable placement of the patient on the patient transfer device 100.

With reference to FIG. 2, the bottom surface 104 includes one or more integrally sculpted regions or recesses which allow air to pass along the bottom surface 104 of the patient transfer device 100. The integrally sculpted regions or recesses form an integrally sculpted configuration that is defined by the bottom surface 104 of the patient transfer device 100. In some embodiments, the patient transfer device 100 can include a variety of sculpting configurations defined by the bottom surface 104 in different regions of the bottom surface 104 to achieve the requisite air flow for creating a low friction interface with a support surface. The different sculpting configurations can ensure that sufficient air flow is passed to areas of the patient transfer device 100 requiring greater support due to placement of the patient on the top surface 102. In some embodiments, the patient transfer device 100 can include an internal pump 124 located within the patient transfer device 100 for passing air flow at or below the bottom surface 104. In some embodiments, the patient transfer device 100 can be connected to an air source 126, e.g., a pump, configured to pass air flow at or below the bottom surface 104.

Figure 3:
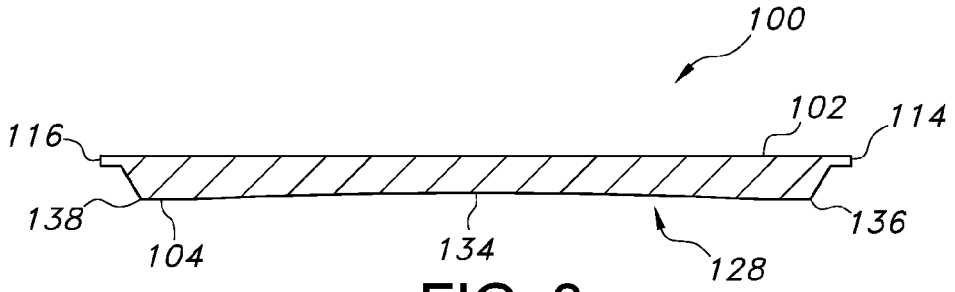
FIG. 3 is a cross-sectional, front view of a first section of an exemplary patient transfer device of FIG. 1.

In the embodiment shown in FIG. 2, the patient transfer device 100 includes three distinct sculpted sections or passages defined by the bottom surface 104, e.g., a first section 128, a second section 130, and a third section 132, formed in or defined by the bottom surface 104. The first, second and third sections 128, 130, 132 can be configured to pass and distribute air flow along the desired portions along and below the bottom surface 104 of the patient transfer device 100. In the embodiment shown in FIG. 2, the first, second and third sections 128, 130, 132 can be different in configuration and size. FIG. 3 shows a cross-sectional view of the first section 128, FIG. 4 shows a cross-sectional view of the second section 130, and FIG. 5 shows a cross-sectional view of the third section 132.

For example, with reference to FIGS. 2 and 3, the first section 128 can define a substantially rectangular configuration. In some embodiments, the first section 128 can define a substantially concave form 134 inwardly directed toward the top surface 102. In particular, the first section 128 can define one continuous, substantially concave form 134. In some embodiments, the thickness of the first section 128, e.g., the distance between the top and bottom surfaces 102, 104 at a central portion of the first section 128, can be approximately 25 mm. In some embodiments, the first section 128 can be spaced from the first end 110 and the side edges 114, 116 of the patient transfer device 100. In some embodiments, the first section 128 can extend between the edges 136, 138 of the bottom surface 104. The first section 128 can thereby define a width substantially similar to or slightly smaller than the width 106 of the patient transfer device 100. It should be understood that air passes along the concave form of the bottom surface 104.

In some embodiments, the first section 128 can extend longitudinally across and encompass approximately seventy percent of the bottom surface 104 of the patient transfer device 100. In some embodiments, the first section 128 can extend across and encompass the area corresponding to the portion of the top surface 102 on which the upper body (or the majority of the body) of the patient is positioned. Thus, the first section 128 can be located below the area of the top surface 102 typically scanned during medical procedures, thereby representing the imaging or treatment area. Due to the location of the first section 128, the first section 128 can be minimally sculpted and includes substantially smooth and minimally curved surfaces such that imaging artifacts can be minimized or prevented. Attenuation can thereby be substantially homogenous for treatment, e.g., diagnostic imaging and radiation therapy treatment beams, static X-ray scanning, CT imaging scanning, or the like.

Figure 4:
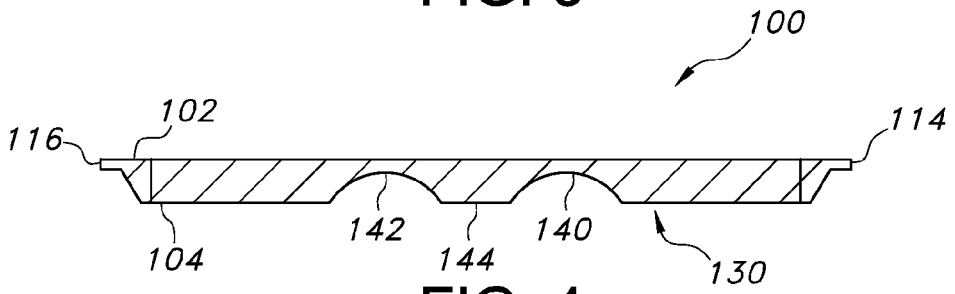
FIG. 4 is a cross-sectional, front view of a second section of an exemplary patient transfer device of FIG. 1.
Figure 5:
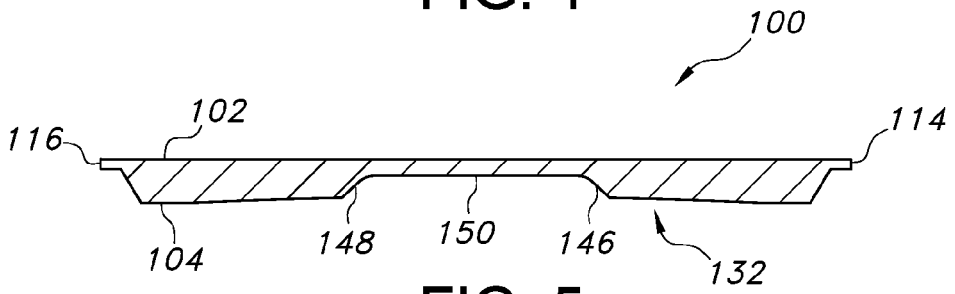
FIG. 5 is a cross-sectional, front view of a third section of an exemplary patient transfer device of FIG. 1.

With reference to FIGS. 2 and 4, the second section 130 can define recesses in the form of two substantially concave grooves 140, 142 which extend lengthwise or longitudinally along the length 108 of the patient transfer device 100. Since the second section 130 is located below the imaging or treatment area, the greater curvature of the grooves 140, 142 relative to the first section 128 does not affect the quality or effectiveness of the imaging or treatment. In some embodiments, the second section 130 can extend across approximately fifteen percent of the bottom surface 104 of the patient transfer device 100. The two grooves 140, 142 of the second section 130 can be spaced apart relative to each other by a separation 144 such that the width defined by the second section 130 is dimensioned smaller than the width of the first section 128. In some embodiments, the width defined by the second section 130 can be approximately half of the width defined by the first section 128. The second section 130 can connect the first section 130 with the third section 132 such that air flow passes therebetween.

With reference to FIGS. 2 and 5, the third section 132 can define a substantially rectangular configuration. In some embodiments, the third section 132 can extend across and encompass approximately twenty percent of the bottom surface 104 of the patient transfer device 100. In some embodiments, the third section 132 can define a substantially concave form. In some embodiments, the third section 132 can define inwardly directed, curved edges 146, 148 and a substantially flat bottom surface 150. The width defined by the third section 132 can be dimensioned substantially similar to the width defined by the second section 130. Since the third section 132 is located below the imaging or treatment area, the greater curvature of the curved edges 146, 148 relative to the first section 128 does not affect the quality or effectiveness of the imaging or treatment.

In some embodiments, air flow can initially be introduced below the bottom surface 104 and the integrally sculpted configuration defined by the bottom surface 104 into the first section 128. As the air flow passes and at least partially fills the first section 128, the air flow can travel through and at least partially fill the second section 130. The air flow can further travel into and at least partially fill the third section 132. In some embodiments, air flow can initially be introduced into the third section 132, thereby at least partially filling the third section 132 before passing to the second and first sections 130, 128. In some embodiments, air flow can be introduced simultaneously into the first, second and third sections 128, 130, 132.

Figure 6A:
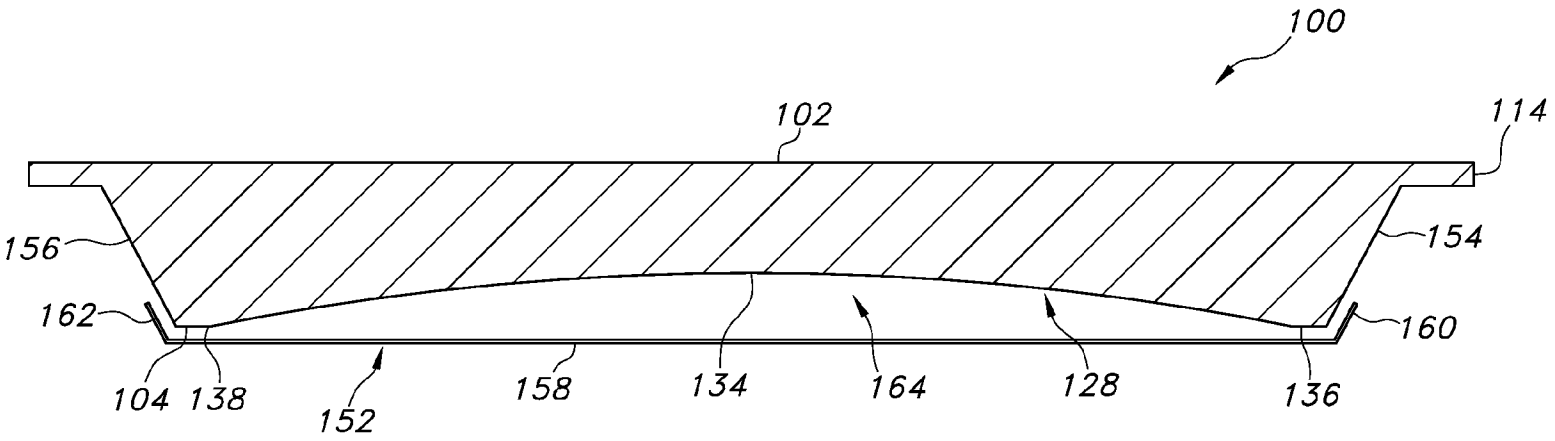
FIG. 6*a* is a cross-sectional, front view of another exemplary patient transfer device including a cover attached thereto.

With reference to FIG. 6*a*, the patient transfer device 100 can include at least one cover 152, e.g., a skin, attached thereto. In some embodiments, the cover 152 can be fixedly secured to the sides 154, 156 of the patient transfer device 100 which define the thickness of the patient transfer device 100, the bottom surface 104, or both. In some embodiments, the cover 152 can be detachably secured to the sides 154, 156, the bottom surface 104, or both, such that the cover 152 can be removed from the patient transfer device 100 for, e.g., cleaning, replacement, repair, and the like. The cover 152 can be secured to the patient transfer device 100 with, e.g., VELCRO®, fasteners, welding, stitching, one or more adhesives, double-sided tape, a seal, o-ring(s), combinations thereof, or the like. The cover 152 can be fabricated from at least one of a rigid material, a flexible material (such an elastomeric material), a coated fabric material, or the like. In some embodiments, the flexible material or the coated fabric material can be stretched across the bottom surface 104 of the patient transfer device 100 to prevent creases or folds in the cover 152. The reduction in creases or folds in the cover 152 ensures an efficient passage of air flow along or below the bottom surface 104. In some embodiments, the rigid material for fabrication of the cover 152 can be, e.g., carbon fiber, non-conductive fibers, a polymer, fiberglass, a non-conductive composite sheet, or the like.

The cover 152 can include a planar bottom surface 158 and flaps 160, 162 extending from opposing side edges of the planar bottom surface 158 for attachment of the cover 152 to the sides 154, 156 of the patient transfer device 100. The cover 152 can be placed along and stretched across the bottom surface 104 of the patient transfer device 100 such that the cover 152 overlaps a majority of the bottom surface 104. In some embodiments, the cover 152 can extend across and cover the entire bottom surface 104 of the patient transfer device 100.

By securing the cover 152 along the bottom surface 104 of the patient transfer device 100, a substantially sealed cavity 164, e.g., a space, a bladder, or the like, can be formed between the bottom surface 104 and the cover 152. The cover 152 further includes one or more perforated regions (see, e.g., FIG. 8) through which air flow can pass. For example, the cover 152 can include one or more perforated regions and one or more unperforated regions. In particular, the cover 152 allows introduced air to travel through the cavity 164 and be distributed along the first, second and third sections 128, 130, 132. The perforated regions in the cover 152 further allow the escaping air flow to create an air bearing against a supporting surface, e.g., a CT scan table, or the like, such that at least a portion of the patient transfer device 100 can be supported for movement along the supporting surface.

Figure 6B:
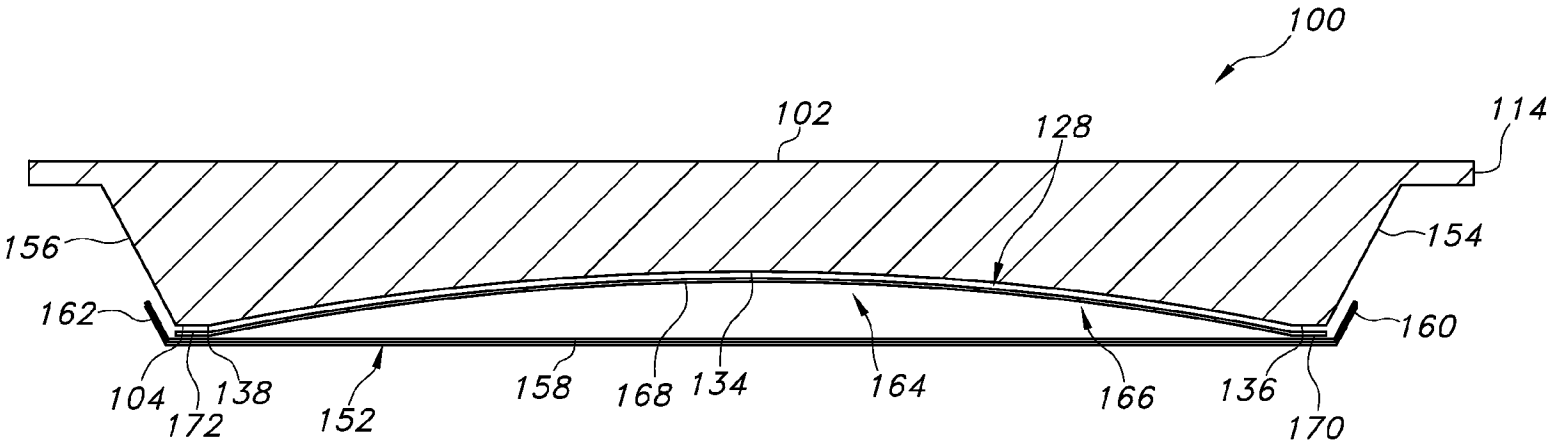
FIG. 6*b* is a cross-sectional, front view of the patient transfer device of FIG. 6*a* including two covers attached thereto.

With reference to FIG.6*b*, in some embodiments, the patient transfer device 100 can include a second cover 166, e.g., an internal skin, a second skin, etc., attached thereto. The second cover 166 can be fabricated from at least one of a rigid material, a flexible material (such as an elastomeric material), a coated fabric material, or the like. The second cover 166 generally does not include perforations. In some embodiments, the cover 166 can be fixedly or removably secured to the bottom surface 104, the concave form 134, the grooves 140, 142, the curved edges 146, 148, the bottom surface 150, or combinations thereof. For example, the cover 166 can include a central section 168, which conforms to the sculpted areas of the bottom surface 104, and further includes side flaps 170, 172 for attachment of the cover 166 to side edges of the bottom surface 104. In particular, the cover 166 can be attached along the bottom surface 104 of the first, second and third sections 128, 130, 132 such that the cover 166 substantially conforms to and defines a complementary shape relative to the sculpted surfaces of the bottom surface 104.

The external cover 152 can be attached to the patient transfer device 100 by overlapping at least a portion of the cover 166 as shown in FIG.6*b*. For example, the covers 152, 166 can be sealed relative to each other at the flaps 170, 172 to form an internal cavity 164, e.g., a space, a bladder, or the like, for distributing air along or below the bottom surface 104 of the patient transfer device 100. Thus, air introduced into the cavity 164 can be selectively distributed through the first, second and third sections 128, 130, 132, creating an air bearing to lift the patient and the patient transfer device 100 for movement. In particular, it should be understood that the flow of air passing through the perforations of the cover 152 can create an air bearing between the cover 152 and the supporting surface of the modality, and further provides sufficient force against the supporting surface to at least partially elevate the patient transfer device 100 above the supporting surface. A patient can thereby be safely positioned and immobilized on the patient transfer device 100 prior to creation of the air bearing, and the air bearing can be created when movement of the patient on the patient transfer device 100 from, e.g., imaging to treatment, is desired. The patient can therefore be moved on one transfer surface without affecting the orientation of the patient for treatment.

Figure 7A:
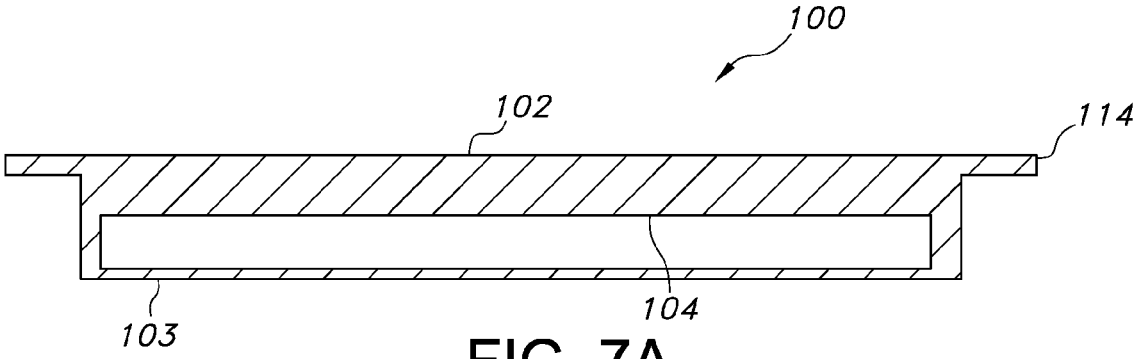
FIG. 7*a* is a cross-sectional, front view of another exemplary patient transfer device including a rigid cover attached thereto.

Referring to FIG. 7*a*, an embodiment is illustrated in which the patient transfer device 100 includes a rigid cover 103 that may be provided with one or more apertures (e.g., perforated). The embodiment also includes a bottom surface 104 that is recessed away from the rigid cover 103 and towards the top surface 102 of the patient transfer device 100, thereby creating a passageway through which air may be delivered such that it is forced through the apertured rigid cover to provide an air bearing. The bottom surface 104 of this particular embodiment may or may not be curved. Also, the rigid cover 103 may or may not be integral with the patient transfer device, i.e., the rigid cover 103 may be a separate removable piece. Additionally, the passageway in such an embodiment may be formed by creating one or more internal passageways within an interior of an integral device.

Figure 7B:
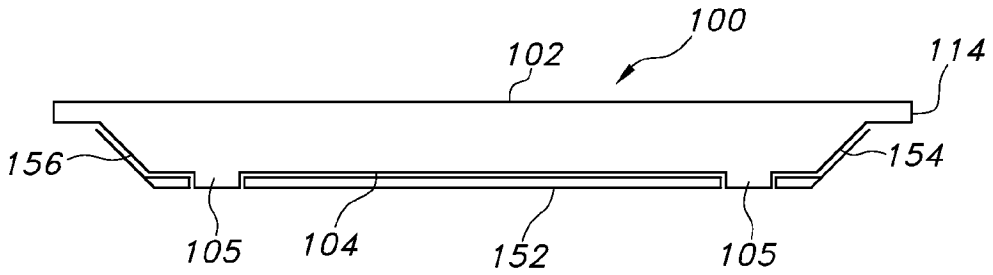
FIG. 7*b* is a front view of another exemplary patient transfer device including spacers and a flexible cover attached thereto.
Figure 7C:
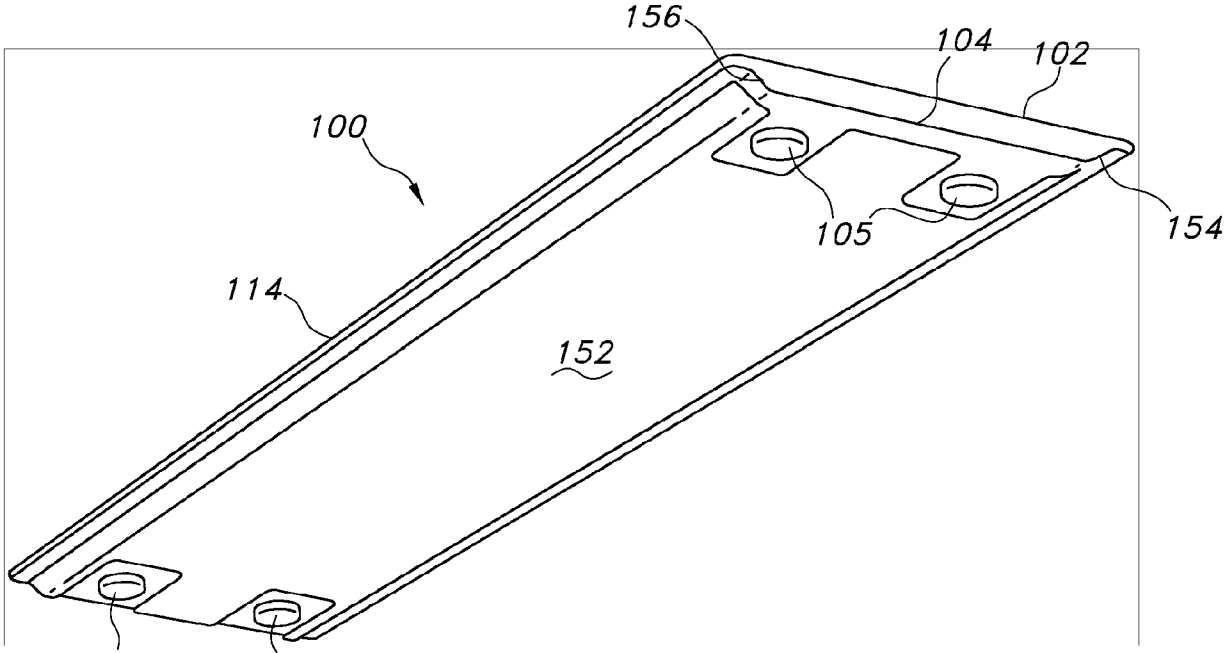
FIG. 7*c* is a bottom perspective view of the patient transfer device of FIG. 7*b;*

In another embodiment illustrated in FIGS. 7*b* and 7*c*, the bottom surface 104 is recessed towards the top surface 102 of the patient transfer device 100 by a plurality of spacers having a height that is greater than the thickness of the cover 152, such as feet 105, to provide a passageway beneath the bottom surface 104 of the patient transfer device 100. In this particular embodiment, a cover 152 is optionally flexible and fastened to the beveled sides 154, 156 of the patient transfer device 100. The flexible cover 152 may be attached to the bottom surface 104 between and/or around the plurality of feet 105, or openings may be provided in the flexible cover 152 through which the plurality of feet 105 may be inserted. The bottom of the feet 105 may optionally have a non-skidding material applied to their bottom surface, such as a rubber or other non-slip coating, to prevent the patient transfer device 100 from sliding across a target surface when the cover 152 is not inflated or when air is not being introduced into the cover 152.

Figure 7D:
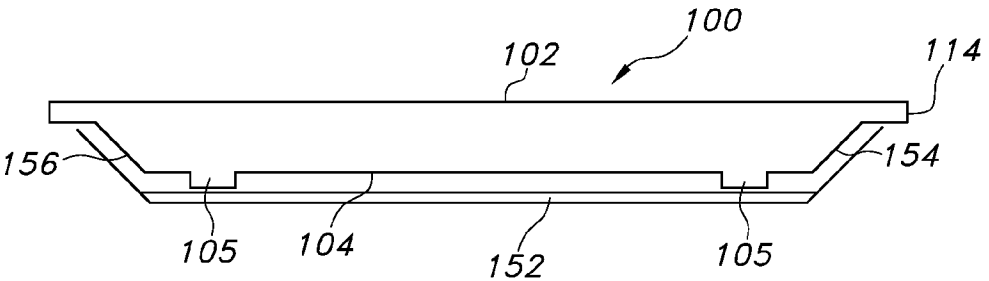
FIG. 7*d* is a front view of another exemplary patient transfer device including spacers and a flexible cover attached thereto.
Figure 7E:
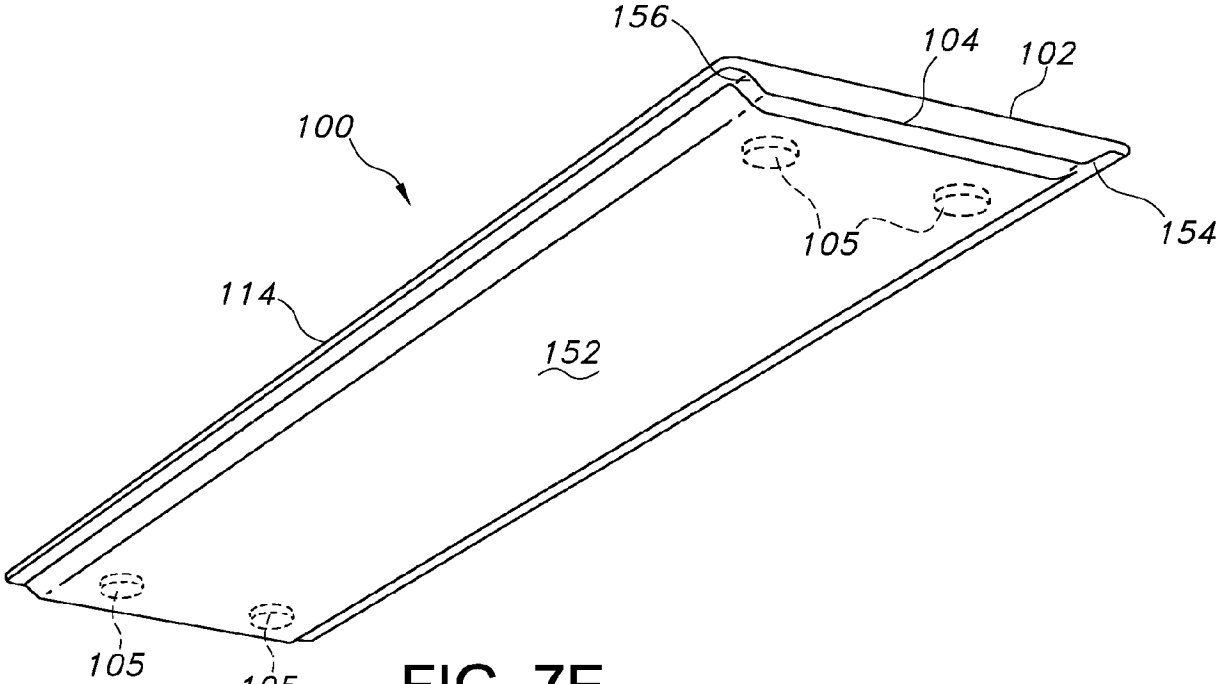
FIG. 7*e* is a bottom perspective view of the patient transfer device of FIG. 7*d;*

In other embodiments, such as the embodiment illustrated in FIGS. 7*d* and 7*e*, the flexible cover 103 may be attached to the sides 154, 156 of the patient transfer device 100 and extend underneath the bottom of the plurality of feet 105. When air is introduced to the cover, the feet 105 prevent a blockage of the air passageway beneath the surface 104, thus allowing the flow of air to various regions of the cover 103.

In some embodiments that utilize the covers, skins, cavities, etc., passage of air below the bottom surface 104 of the patient transfer device 100 acts to inflate the cover or skin into the integrally sculpted configuration that is defined by the bottom surface 104. The inflation of the cover or skin into the configuration defined by the bottom surface 104 may occur in embodiments where a single cover or skin or multiple covers or skins are utilized. In some embodiments, the cover or skin may be applied, such that the cover or skin expands away from the bottom surface 104. For example in FIG. 7*b*, the cover 152 may be pulled taught against the bottom surface 104. Upon inflation, the cover would expand away from the bottom surface 104 and lift the plurality of feet 105 off of the target surface. This configuration would provide the benefit of reducing or eliminating contact between the cover and the support surface, thereby preventing wear on the cover.

In a preferred embodiment, the patient transfer device includes an air bearing that comprises an air-receiving region, such as a bladder, having substantially no side walls. When not inflated or receiving air, the bladder is preferably substantially flat to provide a generally constant thickness that is essentially limited to the thickness of the layer or layers of material from which it is formed. This provides the benefit of reducing and/or eliminating the potential for wrinkles, which can affect the positioning accuracy of the patient on top and create artifacts during imaging and treatment. Preferably, the bladder is fabricated from two flat sheets of flexible material that are sealed to each other such as about their respective peripheries. This material may comprise, for example, a fabric coated with a thin layer of thermoplastic. By placing the two thermoplastic layers directly against each other, the sheets may be welded to each other through conventional means, such as ultrasonic or RF welding, thereby providing a robust and cost-effective manufacturing method. In this way, no additional material is introduced into the bladder that can affect imaging and treatment performance. Alternatively, the sheets may be adhesively bonded, stitched together, or attached by any other means familiar to one skilled in the art. The resulting two sheet air bearing bladder has excellent transfer properties in that it is able to cross relatively large gaps between the trolley and target modality (e.g., gaps up to 10 cm or more), as well as accommodate large differences between the vertical surface height of the trolley and target modality. The air bearings incorporated in the various systems of the present invention may also facilitate transfer between a level trolley and sloped target modality. For example, it is not uncommon for the table of a receiving modality to be two or three centimeters higher on one end versus the other (e.g., head end to foot end).

Figure 8:
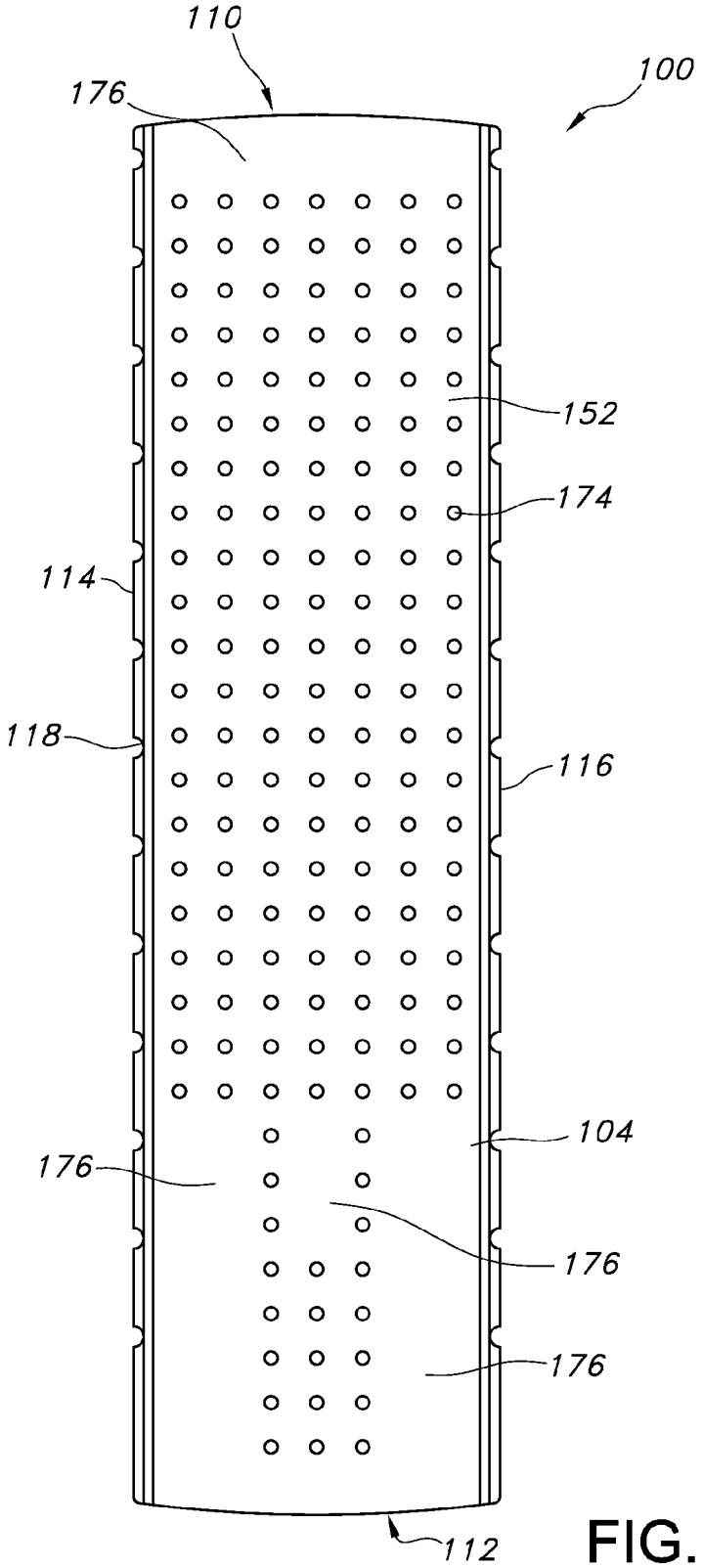
FIG. 8 is a bottom view of an exemplary patient transfer device of FIG. 1 including at least one cover attached thereto.

With reference to FIG. 8, a bottom view of the patient transfer device 100 including the cover 152 is provided. As discussed above, the cover 152 includes a plurality of perforations 174, e.g., regions of perforations 174, and further includes one or more unperforated regions 176. For example, the perforations 174 can be located in positions complementary to at least one of the first, second, or third sections 128, 130, 132 of the bottom surface 104, and the unperforated regions 176 surround at least one of the first, second, or third sections 128, 130, 132. Air flow can thereby be distributed and expelled out of the perforations 174 in areas which contribute to creating the air bearing for lifting the patient transfer device 100 (e.g., inflating the cover 152 into the integrally sculpted configuration defined by the bottom surface 104 of the patient transfer device 100).

Figure 9:
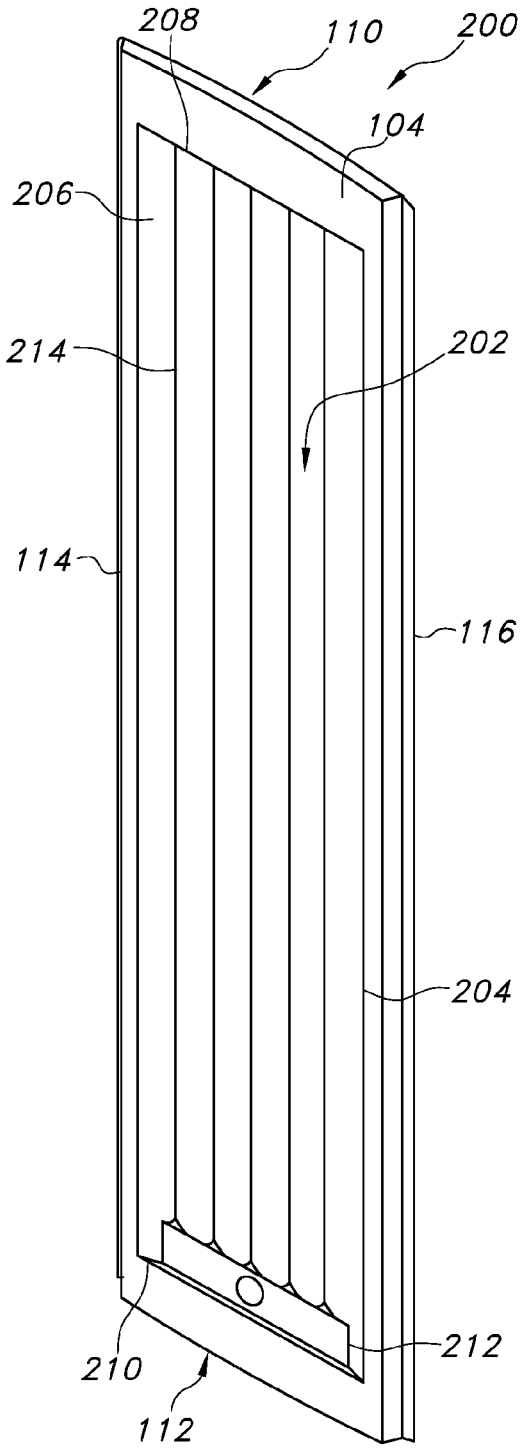
FIG. 9 is a perspective, bottom view of an exemplary patient transfer device according to the present invention.
Figure 10:
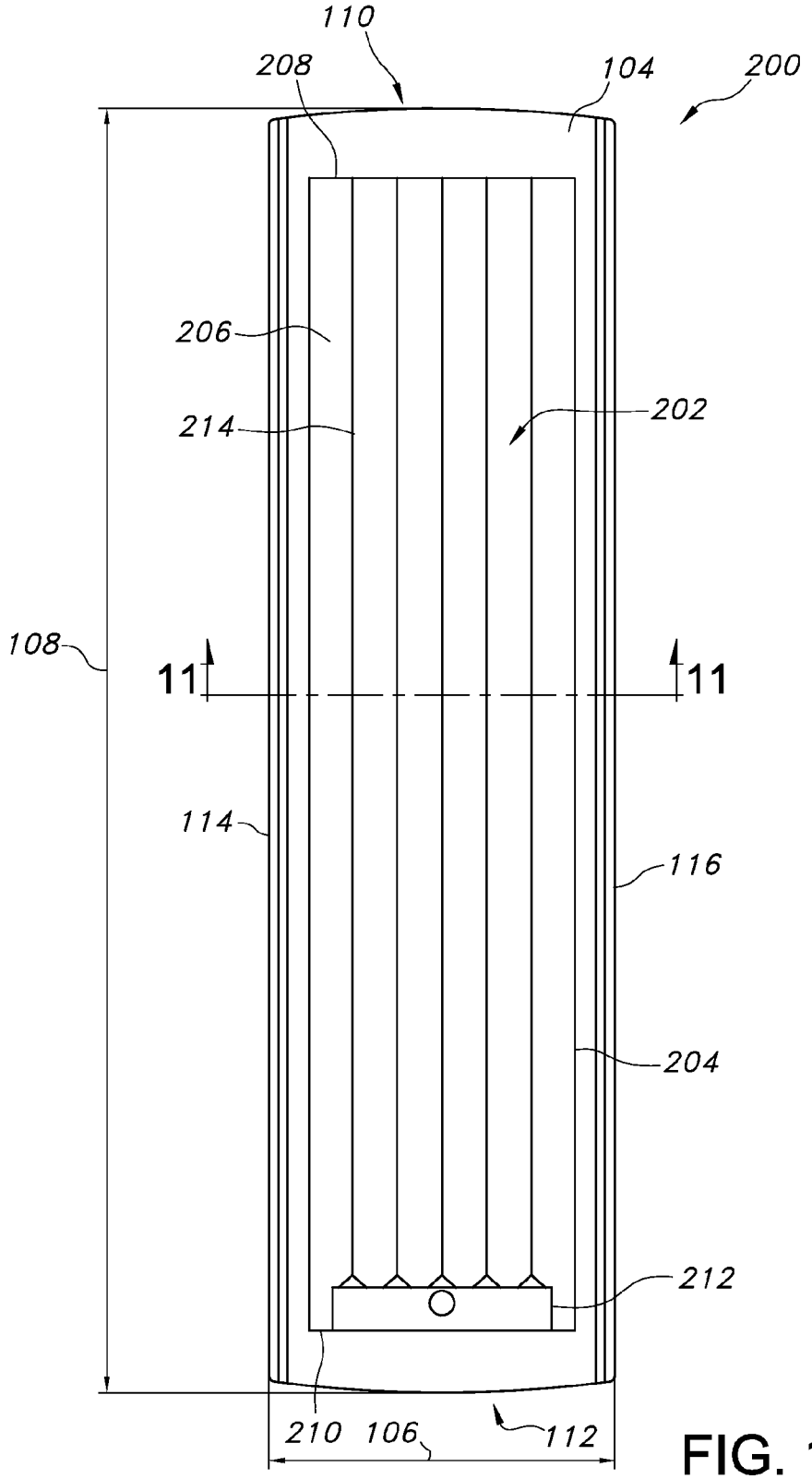
FIG. 10 is a bottom view of an exemplary patient transfer device of FIG. 9.
Figure 11:
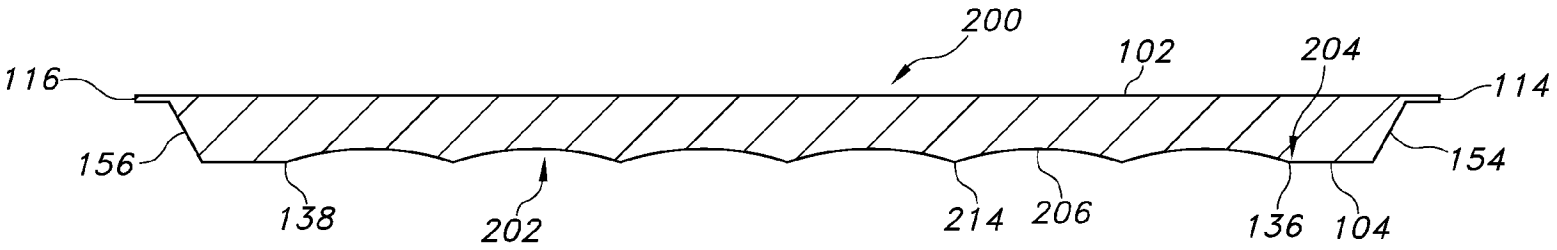
FIG. 11 is a cross-sectional, front view of an exemplary patient transfer device of FIG. 9.
Figure 12:
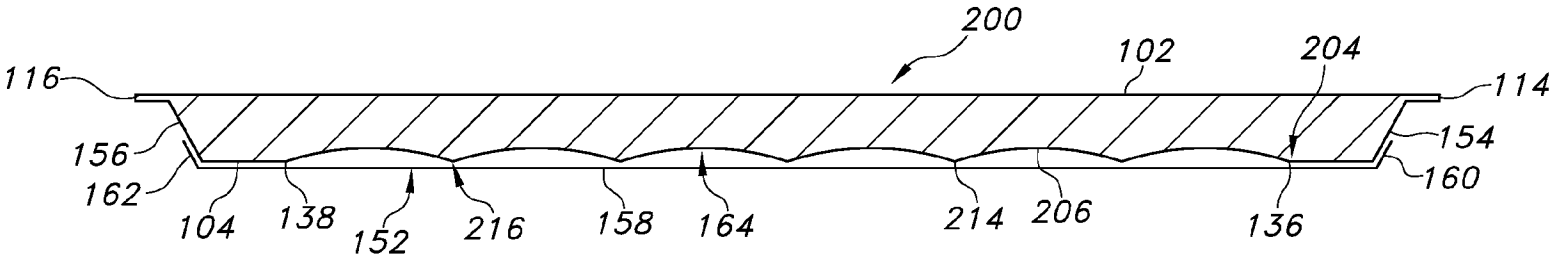
FIG. 12 is a cross-sectional, front view of an exemplary patient transfer device of FIG. 9 including a cover attached thereto.
Figure 13:
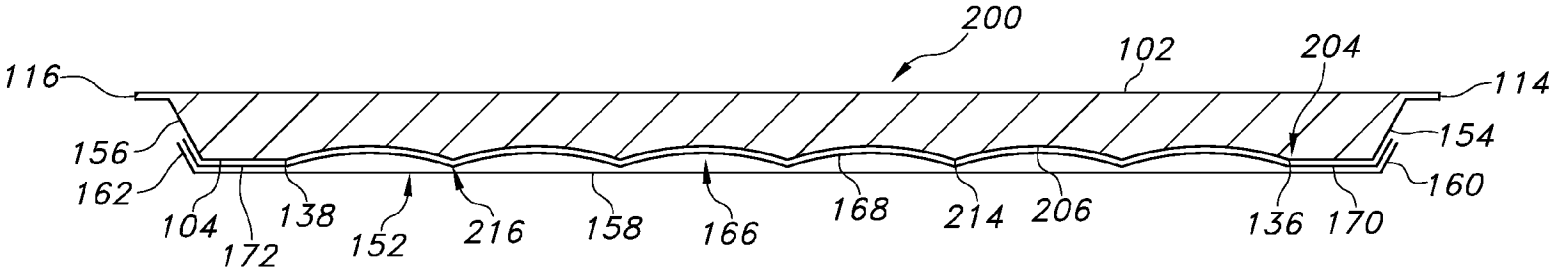
FIG. 13 is a cross-sectional, front view of an exemplary patient transfer device of FIG. 9 including two covers attached thereto.

Turning now to FIGS. 9-13, an alternative patient transfer device 200 is shown. In particular, FIG. 9 shows a perspective, bottom view of the patient transfer device 200. FIG. 10 shows a bottom view of the patient transfer device 200. FIG. 11 shows a cross-sectional view of the patient transfer device 200. FIG. 12 shows a cross-sectional view of the patient transfer device 200 including a cover. FIG. 13 shows a cross-sectional view of the patient transfer device 200 including two covers (e.g., a first skin and a second skin). It should be understood that the patient transfer device 200 can be substantially similar in structure and function to the patient transfer device 100, except for the distinctions noted herein. As such, like structures are marked with like reference numbers.

Rather than including three different configurations of first, second and third sections 128, 130, 132, the patient transfer device 200 of FIGS. 9-13 includes one sculpted section 202 defined by the bottom surface 104 for passage of air along or below the bottom surface 104. The section 202 can be centrally positioned and spaced from the edges of the patient transfer device 200, and can extend longitudinally from the first end 110 to the second end 112. The section 202 can define a substantially rectangular outer perimeter 204. However, it should be understood that alternative configurations of the outer perimeter 204 can be used.

Within the outer perimeter 204, the section 202 includes one or more longitudinal passages 206 extending from a first end 208 to a second end 210 of the perimeter 204 along the length 108 of the patient transfer device 200, e.g., substantially parallel to the length 108 of the patient transfer device 200. In some embodiments, the patient transfer device 200 includes an air source 212, e.g., a pump with an outlet, an air outlet connected to an external air source, or the like, adjacent to or at the second end 210. The centrally located longitudinal passages 206 can therefore extend from the first end 208 to the air source 212. The longitudinal passages 206 can define substantially concave grooves connected relative to each other at raised connecting portions 214. In some embodiments, the connecting portions 214 can define pointed edges. In some embodiments, the connecting portions 214 can define rounded edges.

The longitudinal passages 206 can be in fluid communication with the air source 212 such that air flow can be introduced into the longitudinal passages 206 to flow along and below the bottom surface 104. As shown in FIGS. 12 and 13, the patient transfer device 200 can include a cover 152, a cover 166, or both. In some embodiments, the cover 152 can be positioned along the bottom surface 104 such that the inside surface of the cover 152 abuts the connecting portions 214 between the longitudinal passages 206, thereby isolating each longitudinal passage 206 relative to the other longitudinal passages 206. In such embodiments, air flow can be introduced separately into each of the longitudinal passages 206 and perforations can be formed in the cover 152 in areas corresponding to each longitudinal passage 206 to create the desired air bearing. The passage of air below the bottom surface 104 may inflate the covers 152, 166 into the longitudinal passages 206 (e.g., the integrally sculpted configuration defined by the bottom surface 104), thereby creating the air bearing. In some embodiments, the cover 152 can be positioned along the bottom surface 104 such that a separation 216 exists between the inner surface of the cover 152 and the connecting portions 214. Air can thereby be introduced from one or more sources into the cavity 164 and the separation 216 allows the air flow to be distributed to each of the longitudinal passages 206.

It should be understood that the number of and/or configuration of the longitudinal passages 206, e.g., air passages (the integrally sculpted configuration defined by the bottom surface), can be determined based on a reduction of image artifacts during imaging, e.g., CT imaging, or the like. The size of the individual longitudinal passages 206 can be varied. For example, in some embodiments, the size of each of the longitudinal passages 206 can be substantially similar. In some embodiments, the size of some of the longitudinal passages 206 can be smaller or greater than the other longitudinal passages 206. In some embodiments, the size of the longitudinal passages 206 can be selected based on the rate of air flow desired in the longitudinal passages 206. Thus, although six longitudinal passages 206 are shown in FIGS. 9-13, it should be understood that the number and/or depth of the longitudinal passages 206 can be optimized to provide sufficient air flow for creation of an air cushion with which the patient can be transferred on the patient transfer device 200. In some embodiments, areas along the bottom surface 104 can be selectively formed without longitudinal passages 206.

Minimization of artifacting can be achieved by appropriately designing the shape or configuration of the integrally sculpted regions defined by the bottom surface 104. In some embodiments, a radii of approximately 550 mm of each longitudinal passage 206 can produce the desired results in terms of a reduction in artifacting. In some embodiments, the implementation of large radii, e.g., as large as possible without artifacting, allows the thickness of the patient transfer device 200 to define a minimum variation, thereby minimizing the effect on attenuation homogeneity. Shapes such as ellipses, complex curvatures, contours, and the like can also be employed such that the sculpted surface does not produce artifacts during imaging.

Figure 14:
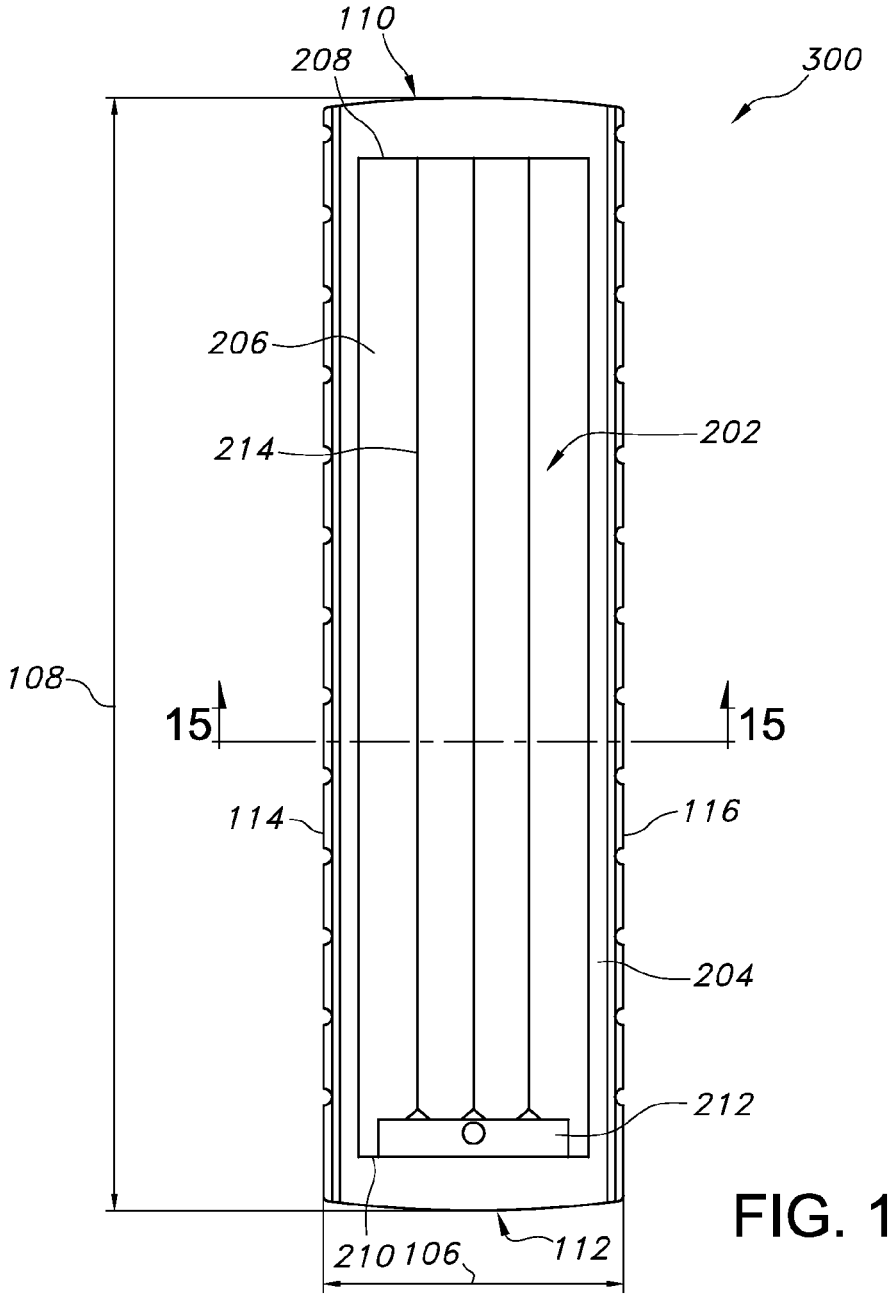
FIG. 14 is a bottom view of an exemplary patient transfer device according to the present invention.
Figure 15:
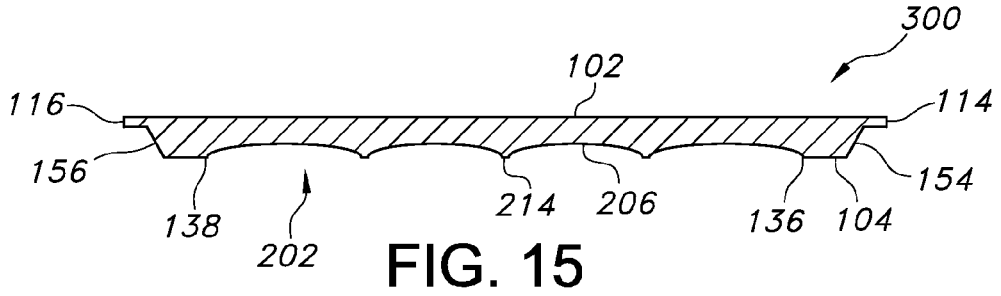
FIG. 15 is a cross-sectional, front view of an exemplary patient transfer device of FIG. 14.

Turning now to FIGS. 14 and 15, an alternative patient transfer device 300 is shown. In particular, FIG. 14 shows a bottom view of the patient transfer device 300 and FIG. 15 shows a cross-sectional view of the patient transfer device 300. It should be understood that the patient transfer device 300 can be substantially similar in structure and function to the patient transfer devices 100, 200, except for the distinctions noted herein. As such, like structures are marked with like reference numbers.

In particular, rather than including six longitudinal passages 206, the patient transfer device 300 of FIGS. 14 and 15 includes four longitudinal passages 206. The longitudinal passages 206 can be dimensioned greater in width as compared to the longitudinal passages 206 of the patient transfer device 200 to ensure that the longitudinal passages 206 cover a sufficient portion of the width 106 of the patient transfer device 300. The greater width of the longitudinal passages 206 can vary the flow of air through the longitudinal passages 206 as compared to the flow of air in the patient transfer device 200. Although illustrated without covers, it should be understood that cover 152, cover 166, or both, can be attached to the patient transfer device 300.

Figure 16:
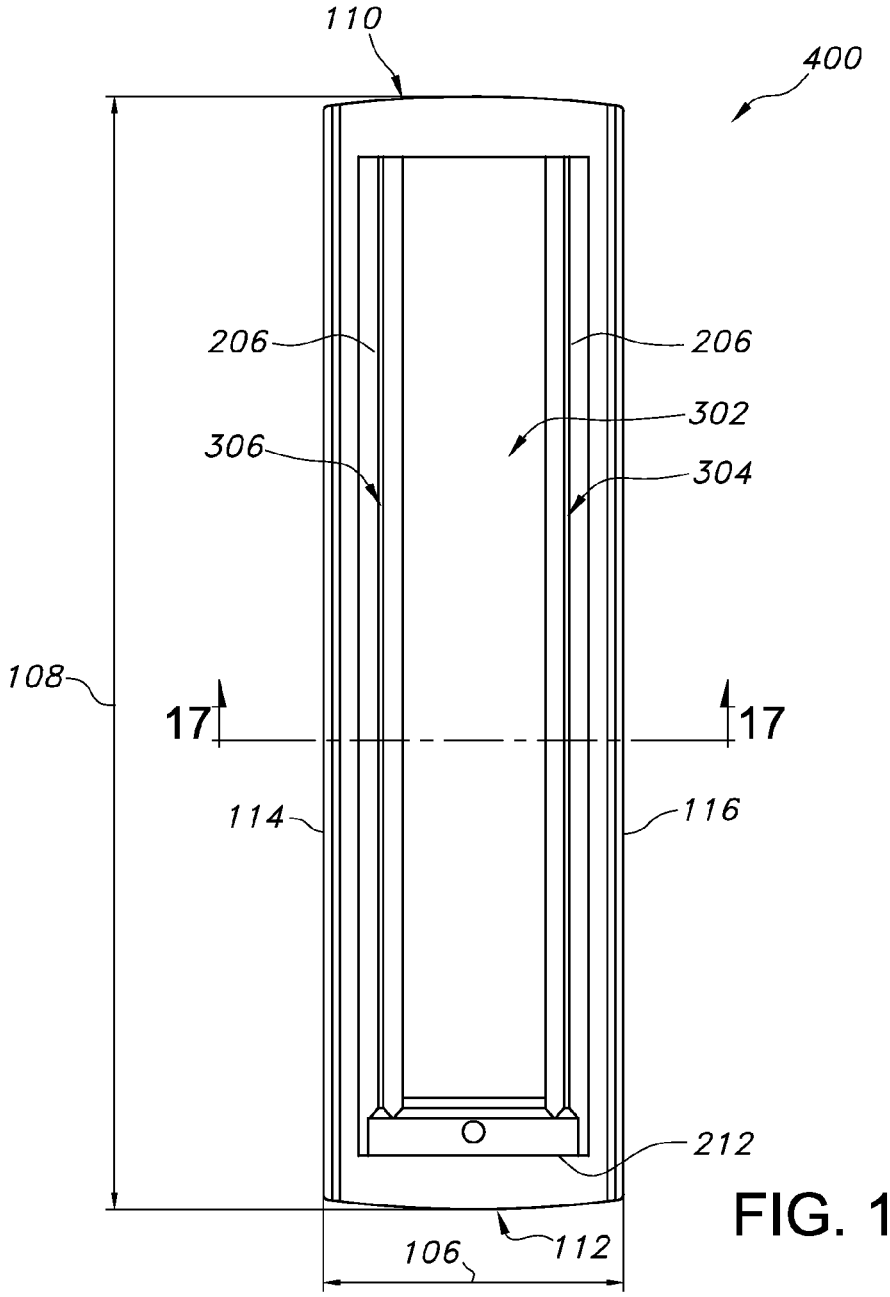
FIG. 16 is a bottom view of an exemplary patient transfer device according to the present invention.
Figure 17:
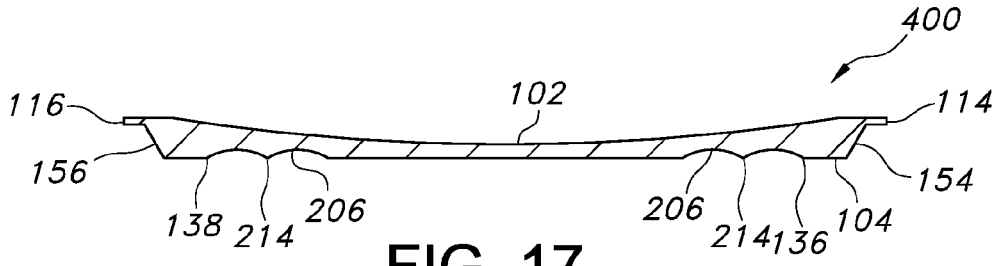
FIG. 17 is a cross-sectional, front view of an exemplary patient transfer device of FIG. 16.

Turning now to FIGS. 16 and 17, an alternative patient transfer device 400 is shown. In particular, FIG. 16 shows a bottom view of the patient transfer device 400 and FIG. 17 shows a cross-sectional view of the patient transfer device 400. It should be understood that the patient transfer device 400 can be substantially similar in structure and function to the patient transfer devices 100, 200, 300, except for the distinctions noted herein. As such, like structures are marked with like reference numbers.

In particular, the patient transfer device 400 includes three sections for passage of air flow, e.g., a first section 302, a second section 304, and a third section 306. Rather than each section extending only a portion of the length 108 of the patient transfer device 400 (see, e.g., the patient transfer device 100), the first, second and third sections 302, 304, 306 of the patient transfer device 400 can extend substantially similar longitudinal distances along the length 108.

In some embodiments, the first section 302 can be centrally located between the second and third sections 304, 306. The first section 302 can define a substantially planar or partially concave surface along which air can flow. In some embodiments, the first section 302 can be substantially devoid of air flow and air can be introduced only to the second and third sections 304, 306 such that an air bearing is created on opposing sides of the patient transfer device 400.

For example, the second and third sections 304, 306 can be substantially similar in structure and function and are positioned on opposing sides of the first section 302. In particular, the second and third sections 304, 306 can extend parallel to and spaced from the side edges 114, 116. In some embodiments, the second and third sections 304, 306 can extend approximately ninety percent of the length 108 of the patient transfer device 400. Although shown as extending only along the sides of the patient transfer device 400, in some embodiments, the second and third sections 304, 306 can extend along a substantial portion of the perimeter of the bottom surface 104 such that an air bearing can be created along the perimeter of the patient transfer device 400.

The second and third sections 304, 306 can be substantially similar to the longitudinal passages 206 discussed above. It should be understood that each of the second and third sections 304, 306 can include one or more longitudinal passages 206 joined at connecting portions 214. Thus, air flow introduced into the second and third sections 304, 306 can create an air bearing near the edges 114, 116 of the patient transfer device 400 for movement of the patient. Although illustrated without covers, it should be understood that cover 152, cover 166, or both, can be attached to the patient transfer device 400.

With reference to FIG. 17, in some embodiments, the top surface 102 of the patient transfer device 400 can define a substantially concave form. The concave form allows the thickness of the center of the patient transfer device 400 to be minimized, thereby allowing the patient to be positioned closer to the bottom surface 104. The minimized thickness of the patient transfer device 400 can be advantageous in a variety of medical procedures. For example, when patients are imaged using MRI, an antenna coil can be placed under the patient supporting surface and/or the patient transfer device 400.

By minimizing the thickness of the patient transfer device 400, the patient can be positioned closer to the coil, resulting in higher quality images. The minimized thickness can also be beneficial for alternative treatment techniques, such as brachytherapy. In some embodiments, the thickness of the central longitudinal region of the patient transfer device 400 can be approximately 25 mm or less. In some embodiments, the thickness of the central longitudinal region of the patient transfer device 400 can be approximately 15 mm or less. In some embodiments, the thickness of the central longitudinal region of the patient transfer device 400 can be approximately 5 mm or less.

Figure 18:
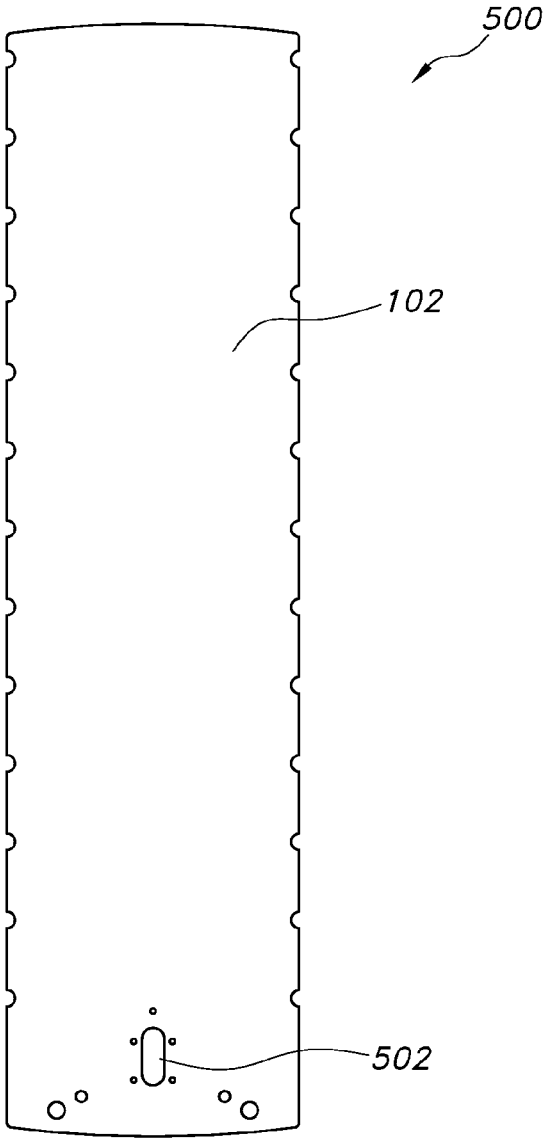
FIG. 18 is a top view of a top surface of an embodiment of a patient transfer device.
Figure 19:
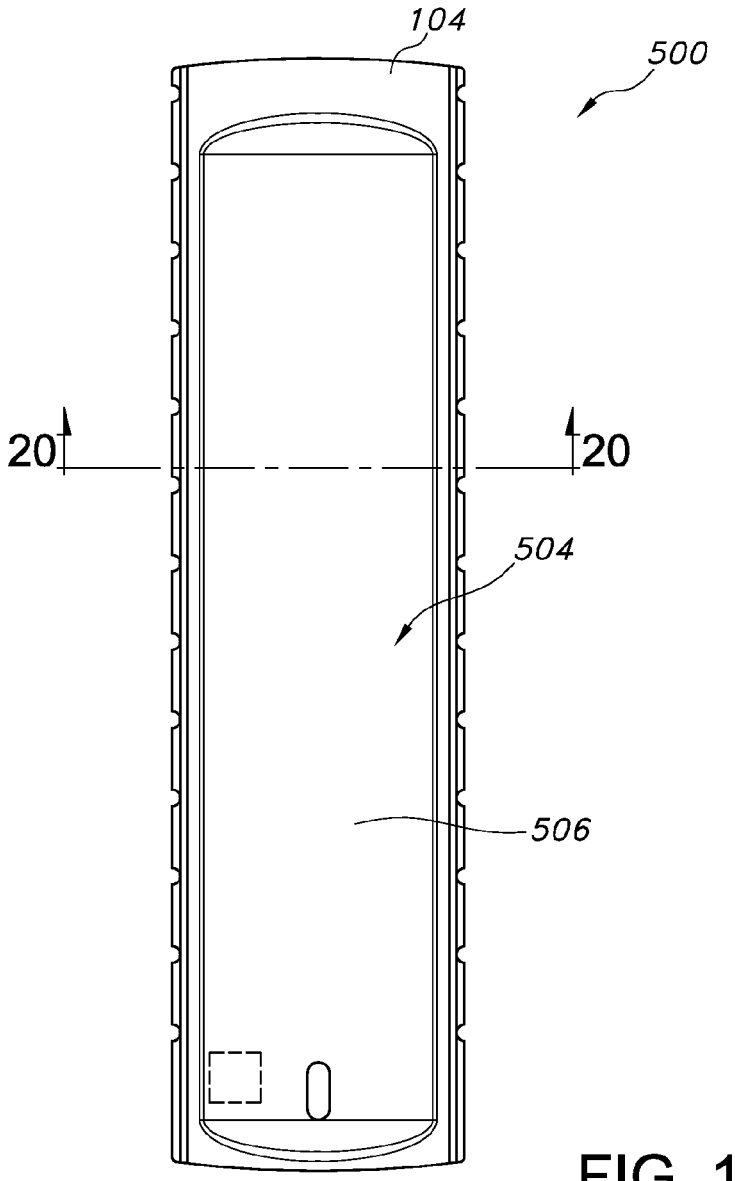
FIG. 19 is a view of a bottom surface of the patient transfer device of FIG. 18.
Figure 20:
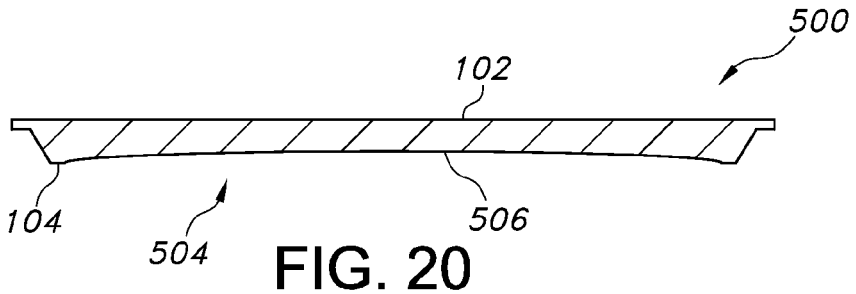
FIG. 20 is a cross-sectional view of the patient transfer device of FIG. 18.

Referring next to FIGS. 18-20, a patient transfer device 500 is depicted. FIG. 18 depicts the top surface of the device 500, FIG. 19 depicts the bottom surface 104 of the patient transfer device 500, and FIG. 20 is a cross-sectional view of the patient transfer device 500. It should be understood that the patient transfer device 500 can be substantially similar in structure and function to the patient transfer devices 100, 200, 300, 400 except for the distinctions noted herein. As such, like structures are marked with like reference numbers.

The patient transfer device 500 additionally includes an indexing aperture 502 that extends through the top surface 102 and the bottom surface 104 and provides additional indexing accuracy. The bottom surface 104 includes an integrally sculpted configuration 504 that defines a recess. The configuration 504 forms a single longitudinal passage 506 that extends along the bottom surface 104. Although not depicted, the bottom surface 104 may include a cover, or multiple covers, such that the covers inflate into the configuration 504 when air flow is passed below the bottom surface 104.

Figure 21:
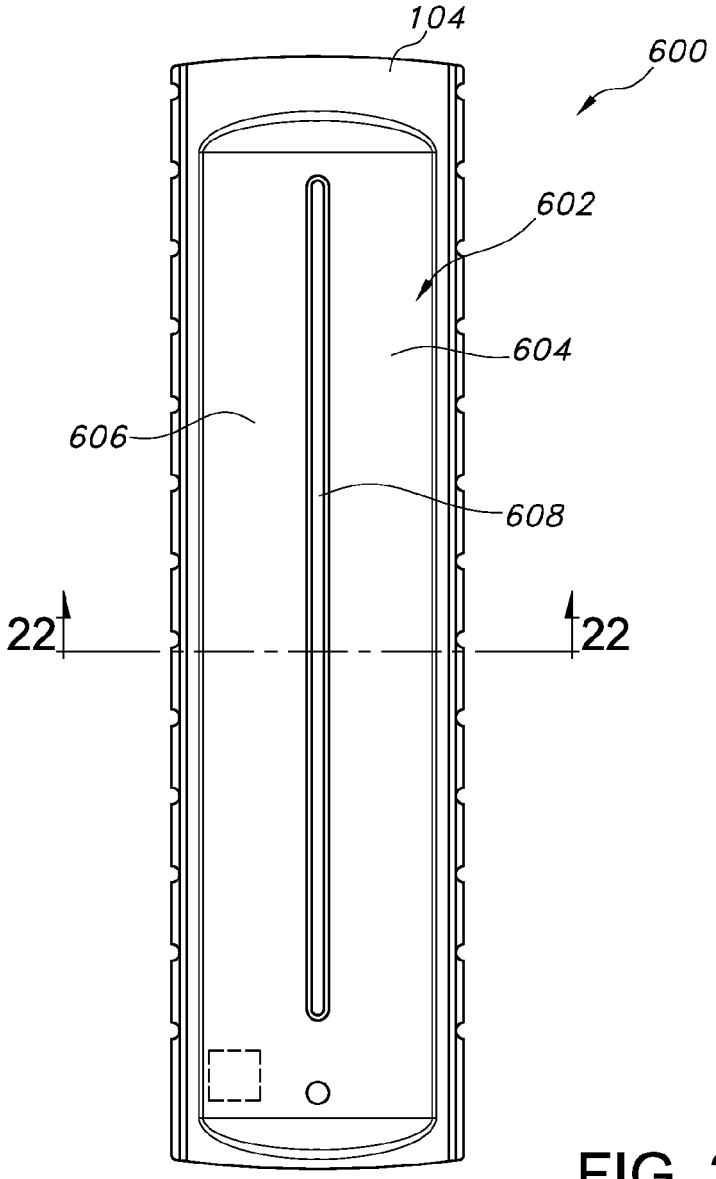
FIG. 21 is a view of a bottom surface of another embodiment of a patient transfer device.
Figure 22:
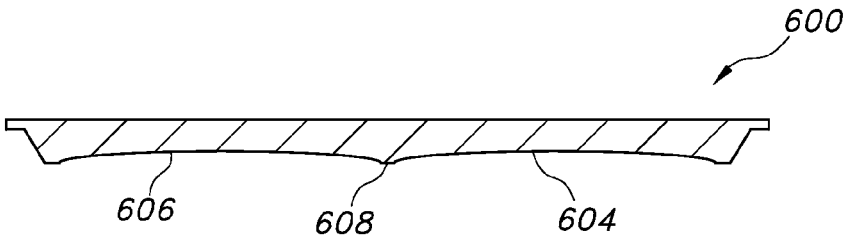
FIGS. 22, 23*a*, and 23*b* are cross-sectional views of the patient transfer device of FIG. 21.

Referring next to FIGS. 21-24, another embodiment of a patient transfer device 600 is shown. FIG. 21 shows the bottom surface 104 of the device 600, and FIGS. 22-24 are various cross-sectional views of the device 600. It should be understood that the patient transfer device 600 can be substantially similar in structure and function to the patient transfer devices 100, 200, 300, 400, 500 except for the distinctions noted herein. As such, like structures are marked with like reference numbers.

Figure 23A:
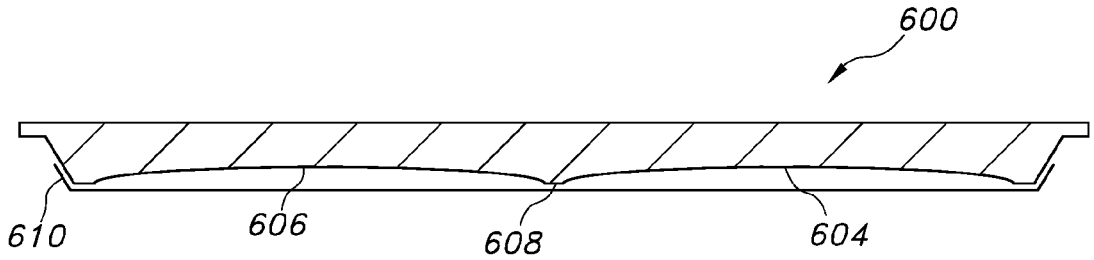
Figure 23B:
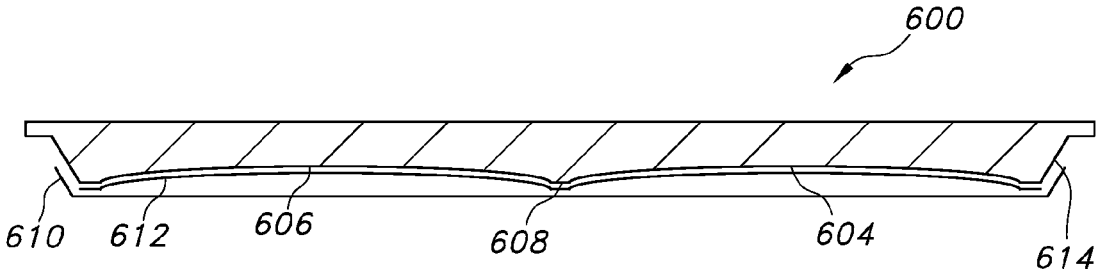
Figure 24A:
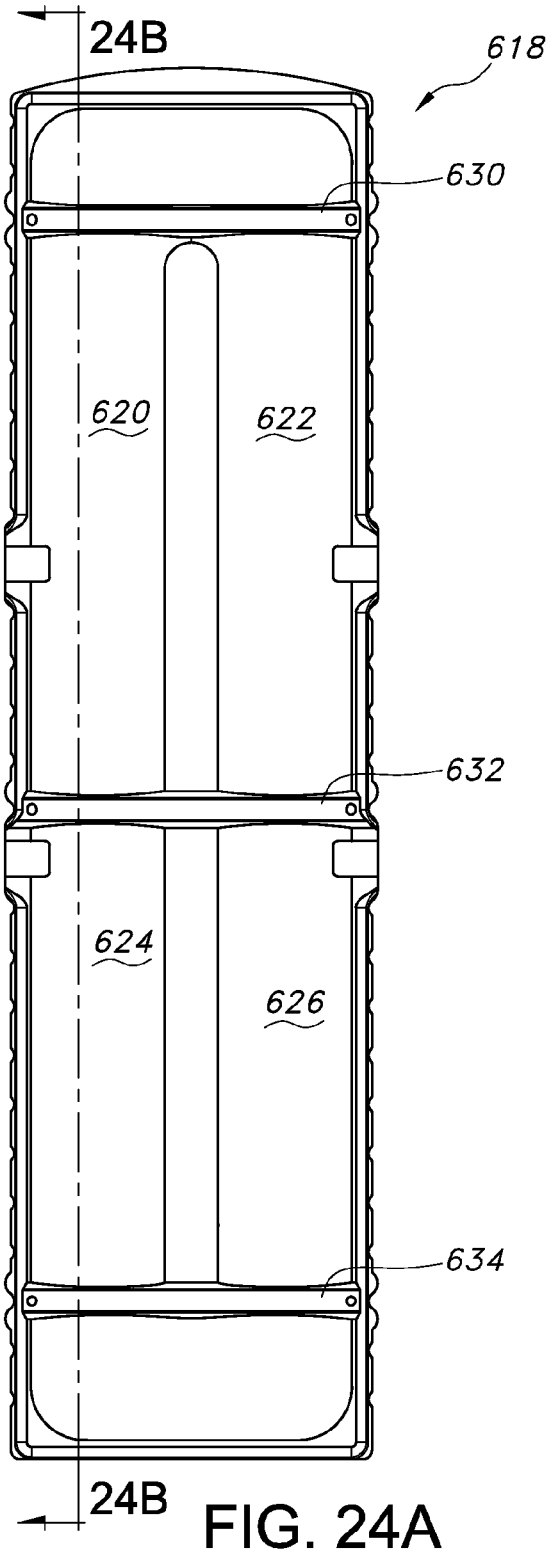
FIG. 24*a* is a view of a bottom surface of another embodiment of a patient transfer device.
Figure 24B:
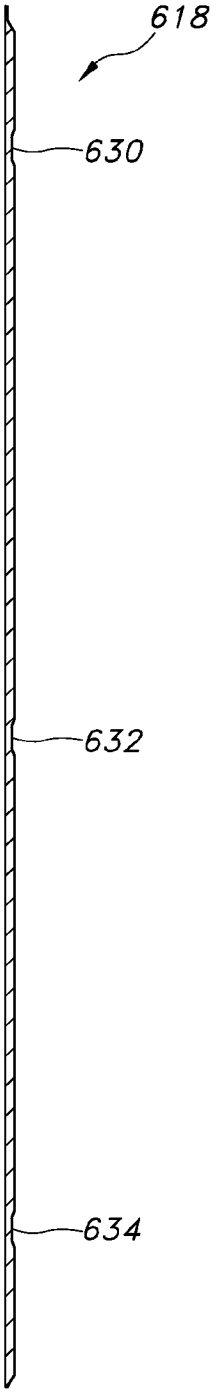
FIG. 24*b* is a side cross-sectional view of the patient transfer device of FIG. 24*a*

Defined by the bottom surface 104 of the patient transfer device 600 is a recess shaped by an integrally sculpted configuration 602. The configuration 602 defines two recesses in the form of two sections 604, 606 that extend along the bottom surface 104 and that are separated by a center section 608. When air is passed below the bottom surface 104, the air may enter the sections 604, 606 while the center section 608 remains devoid of air flow. As depicted in FIG. 23*a*, a single cover 610 may be utilized such that when air is passed below the bottom surface 104, the cover 610 may create the air bearing. Alternatively, a pair of covers 610, 612 may be used such that the intermediate cover 612 extends into the sections 604, 606 when air is delivered between the covers 610, 612, as illustrated in FIG. 23*b*. The patient transfer device 600 may also include a beveled edge 614 to provide an attachment surface for the cover 610. Any attachment means may be incorporated on the beveled edge 614 and the beveled edge 614 may be conformed to any suitable angle. For example, a touch fastener may be applied to the beveled edge 614, as well as the perimeter edge region of the cover 610. When using a touch fastener, the beveled edge 614 may be preferably about 45 degrees relative to the surface upon which the patient transfer device rests.

Figure 43:
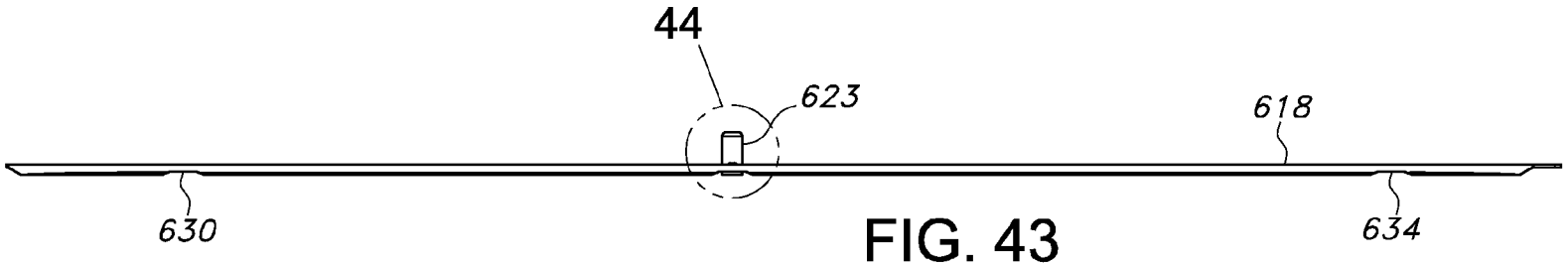
FIG. 43 is a side view of an indexing feature inserted through an indexing groove in the patient transfer device of FIG. 24*b*.
Figure 44:
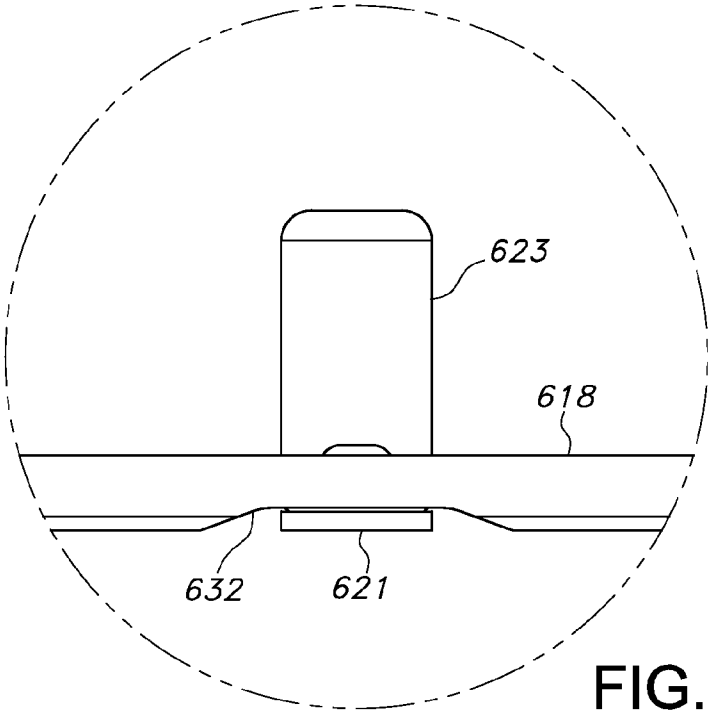
FIG. 44 is magnified view of region "44" in FIG. 43.

The longitudinal recesses 604, 606 communicate with one another by transverse recesses that may be positioned at any location along the length of the patient support. For example referring to FIGS. 24*a* and 24*b*, another embodiment of a patient transfer device 618 is shown, which includes longitudinal recesses 620, 622, 624, 626 that are in fluid communication via two transverse recesses located at the head and foot of the patient transfer device 618 (above indexing groove 630 and below indexing groove 634). The patient transfer device may also include a set of transverse indexing grooves 630, 632, 634 to ensure air is not cut off when an indexing feature is used to locate the patient transfer surface 618. In FIG. 43, an example of an indexing feature 623 is inserted into the middle indexing groove 632 of patient transfer device 618. Referring to FIG. 44, the indexing feature 623 includes a base section 621, and it is preferred that the height of the indexing groove 632 is greater than the height of the base section 621 to allow air to travel between the bottom surface of the patient transfer device 618 and the top of the base section 621, so that the longitudinal recesses 604, 606 may receive the air on either side of the indexing feature 623. All of the recesses may be provided in any variety of straight, curved, or angled configurations.

Figure 25:
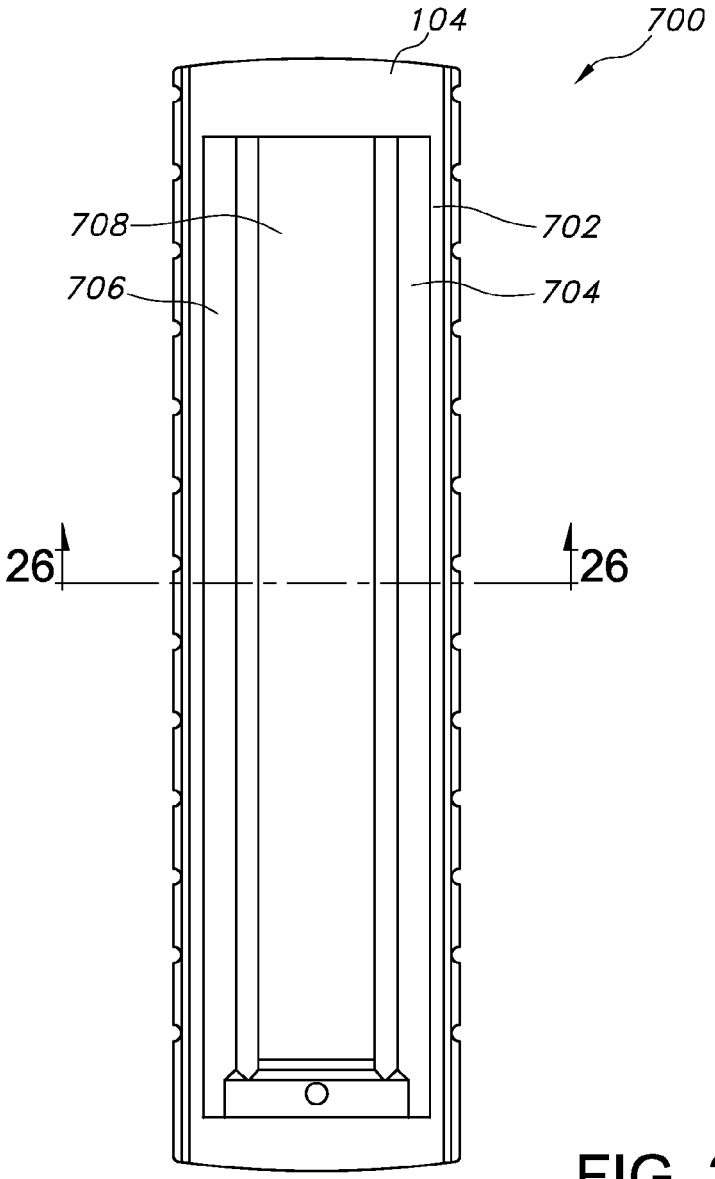
FIG. 25 is a view of a bottom surface of another embodiment of a patient transfer device.
Figure 26:
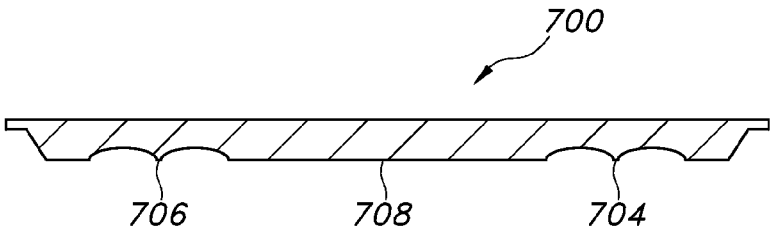
FIG. 26 is a cross sectional view of the patient transfer device of FIG. 25.

With reference to FIGS. 25 and 26, an embodiment of a patient transfer device 700 is shown. FIG. 25 shows the bottom surface 104 of the patient transfer device 700, and FIG. 26 is a cross-sectional view of the patient transfer device 700. It should be understood that the patient transfer device 700 can be substantially similar in structure and function to the patient transfer devices 100, 200, 300, 400, 500, 600 except for the distinctions noted herein. As such, like structures are marked with like reference numbers.

The patient transfer device 700 includes an integrally sculpted configuration 702 forming recesses defined by the bottom surface 104. The configuration 702 includes two recesses in the form of sections 704 and 706, with each section having two longitudinal passages that extend along the bottom surface 104. The sections 704 and 706 are separated by a center section 708. When air is passed below the bottom surface 104, it may enter the two sections 706 and 708 to create the air bearing, with the center section 708 being substantially devoid of air flow. Although not depicted, the device 700 may include a single cover or multiple covers, such that the passage of air flow inflates the covers into the longitudinal passages of the sections 704, 706.

The sculpting of the regions/configurations defined by the bottom surface 104 as described herein can be any shape desired for particular medical applications, e.g., domed, semi-circular, combinations thereof, and the like. In some embodiments, the sculpting can include slightly concave curvatures such that artifacting can be minimized in the patient image for, e.g., static X-ray scan, CT scans, and the like. In some embodiments, the depth of the concave sculpting may be approximately 10 mm or less, more preferably approximately 5 mm or less. The depth of the concave sculpting may also be optimized to minimize the impact the sculpting has on treatment beam attenuation.

Thus, the patient transfer devices disclosed herein can be advantageously used to position or immobilize the patient for imaging, to transport the patient between modalities for treatment, and to maintain the proper patient orientation during treatment. For example, the patient transfer devices can be used for a variety of medical treatments, e.g., head and neck cancer, lung cancer, breast cancer, prostate cancer, and the like, via external beam radiation therapy, internal beam radiation therapy, or both.

Although the patient transfer devices have been described for use in radiation therapy and associated imaging, it should be understood that the patient transfer devices can also be used in other applications for transporting patients. For example, situations where a patient is incapable of moving from one patient support device to another under their own power can be made easier through the use of the disclosed patient transfer devices. As a further example, these situations can occur in emergency room environments in which the patient must be taken to a CAT scan or MRI in order to diagnose their injury. In one possible scenario, the patient can be placed on a patient transfer device upon arriving at the hospital. After entering the hospital, the patient can be transported to the imaging room and transferred to the couch top of the imaging modality. By using the patient transfer device, stress on the patient and the staff can be minimized by reducing the amount of lifting and manipulation required to transport the patient.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

Figure 27:
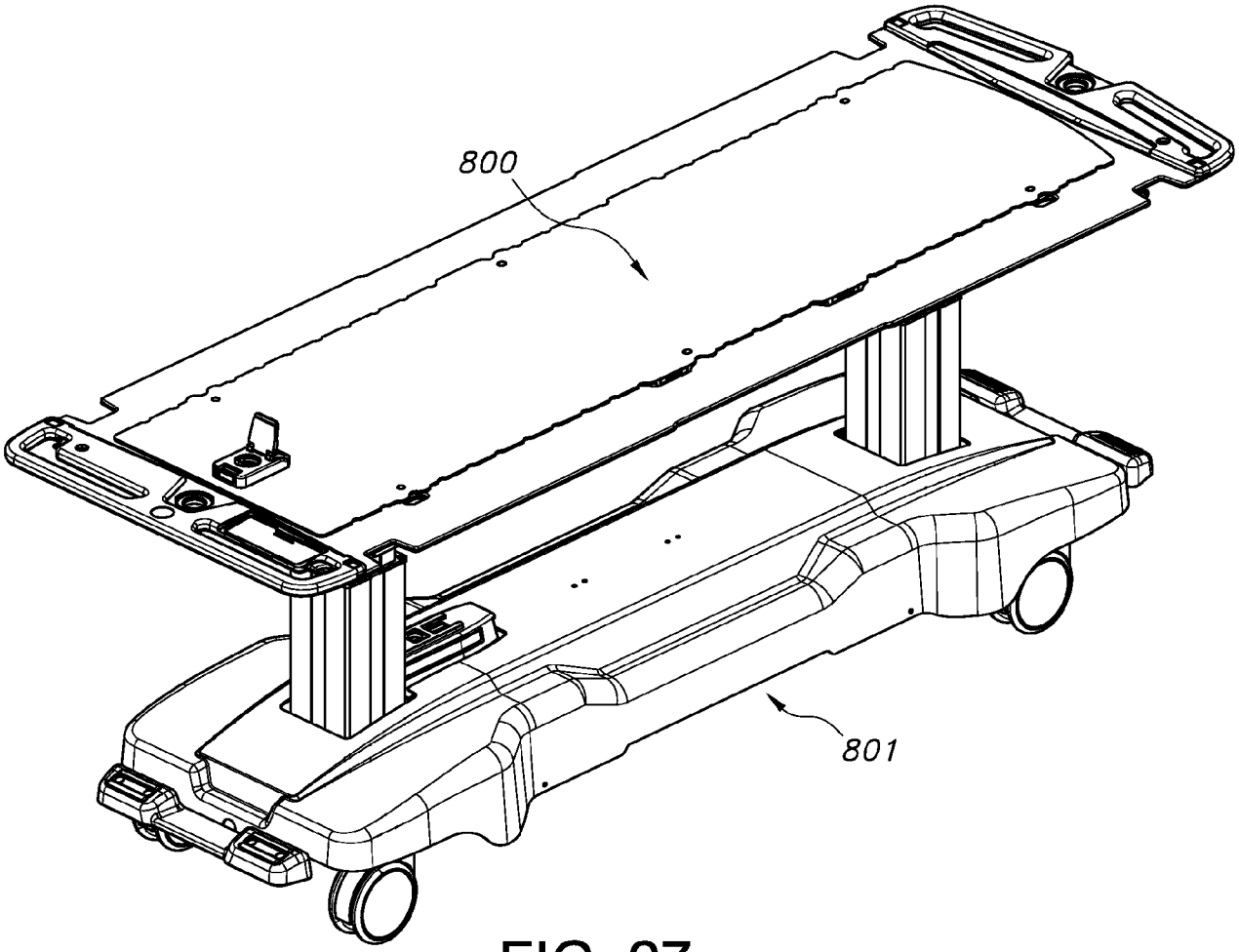
FIG. 27 is a perspective view of another embodiment of a patient transfer device, illustrated on a trolley according to one aspect of this invention.

FIG. 27 is a perspective view of another embodiment of a patient transfer device, illustrated on a trolley according to one aspect of this invention. FIG. 27 illustrates a patient transfer device 800 positioned on a trolley 801. Trolley 801 is one example of a modality according to one aspect of this invention. It is shown schematically for purposes of illustration, and may have many various configurations. Generally, trolley 801 provides a support surface on its top, over which the patient transfer device 800 is positioned.

Figure 28:
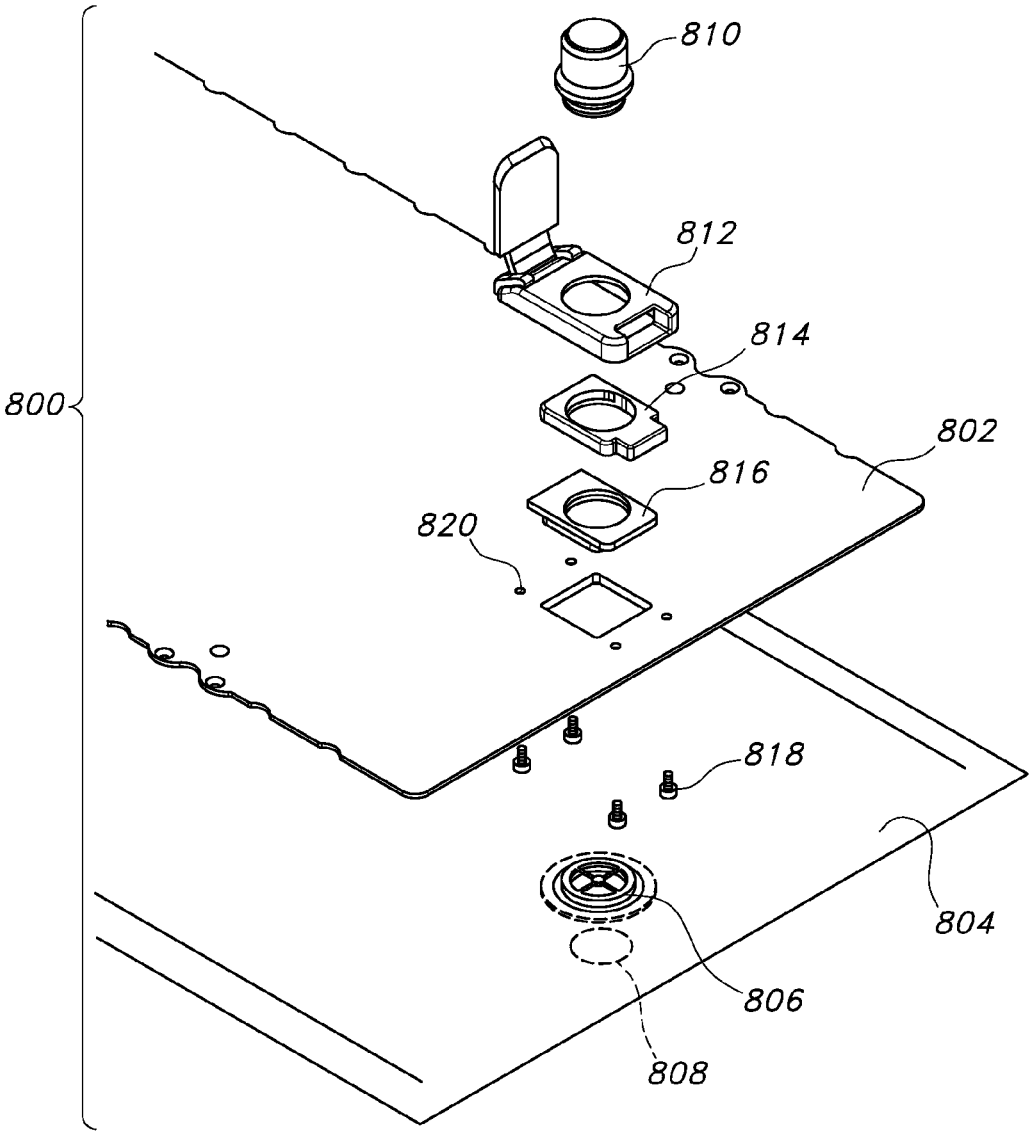
FIG. 28 is an exploded view of the patient transfer device illustrated in FIG. 27.

FIG. 28 is an exploded view of the patient transfer device illustrated in FIG. 27. FIG. 28 shows various components of the patient transfer device 800 illustrated in FIG. 27. Patient transfer device 800 includes a patient support 802 that is coupled or otherwise associated with a bladder 804. The patient support 802 is formed from a material that is relatively rigid as compared to the bladder 804. It can be formed from a variety of substantially rigid materials. It is preferably radiolucent or X-Ray homogenous.

Bladder 804 may include a valve 806 through which air can pass to an interior region defined by the bladder 804. The interior region may be defined by the bladder 804 and a surface of the patient support 802 if a single cover layer is used to form the bladder 804. Alternatively, and as shown in this embodiment, the bladder 804 is formed from two cover layers.

The valve 806, which includes a valve membrane 808, may be a check valve permitting flow in one direction. For example it may be an umbrella style valve or any other suitable valve configuration. The valve 806 permits the flow of air into an interior region of the bladder 804 and may be provided in a wide variety of locations or configurations.

Figure 39:
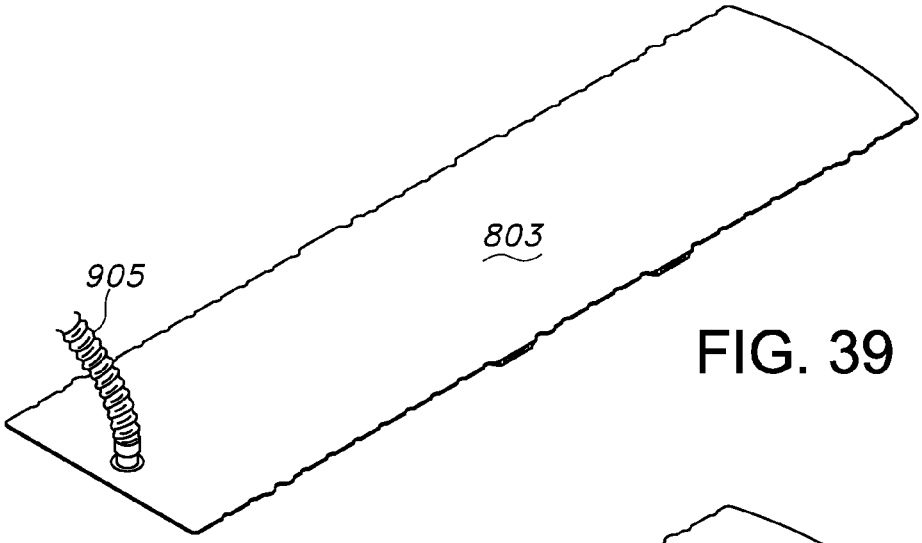
FIG. 39 is a top perspective view of an exemplary patient transfer device according to the present invention attached to an air supply line.
Figure 40:
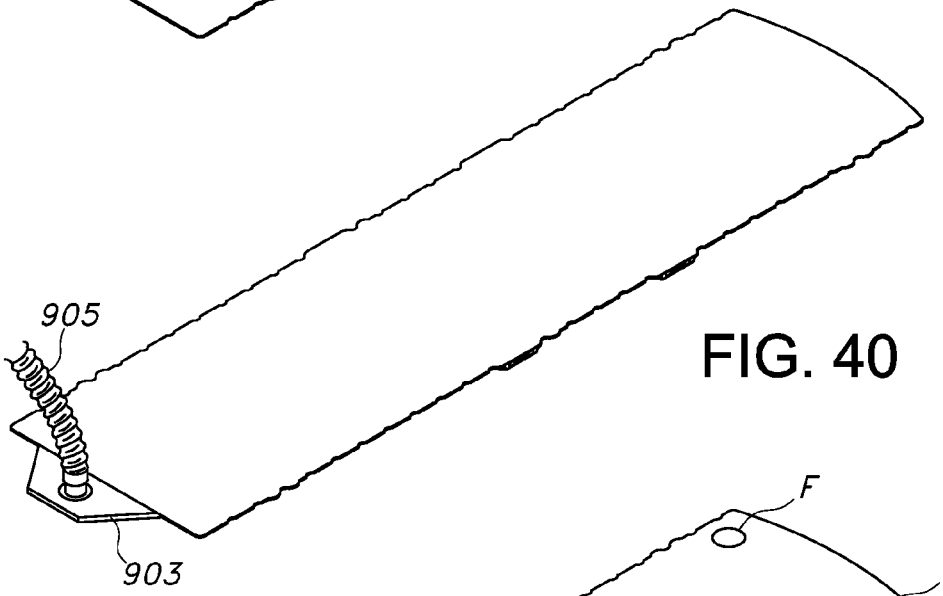
FIG. 40 is a top perspective view of another exemplary patient transfer device according to the present invention attached to an air supply line.

A hose coupling 810 is configured to be coupled to the end of an air hose, such as an air hose 905 illustrated in FIGS. 39 and 40. The hose is preferably flexible and can be selected from a wide variety of configurations.

A housing 812 is provided to receive the hose coupling 810. It is shown in an open configuration in FIG. 28. The housing 812 covers and encloses a latch 814 that is positioned to capture the hose coupling 810. A mounting portion 816 is mounted to the patient support 802 by fasteners 818 that engage the mounting portion 816 via mounting holes 820.

FIG. 29 is a top view of a valve cover component of the patient transfer device illustrated in FIG. 27. FIG. 29 shows a top plan view of the housing 812 in a closed position. It can be provided in a wide range of shapes and sizes and configurations.

FIG. 30 is a side view of the valve and mounting portion of an air supply hose and illustrates the relationship of the hose coupling 810 before it is inserted into the latch 814 within the housing 812.

Figure 31A:
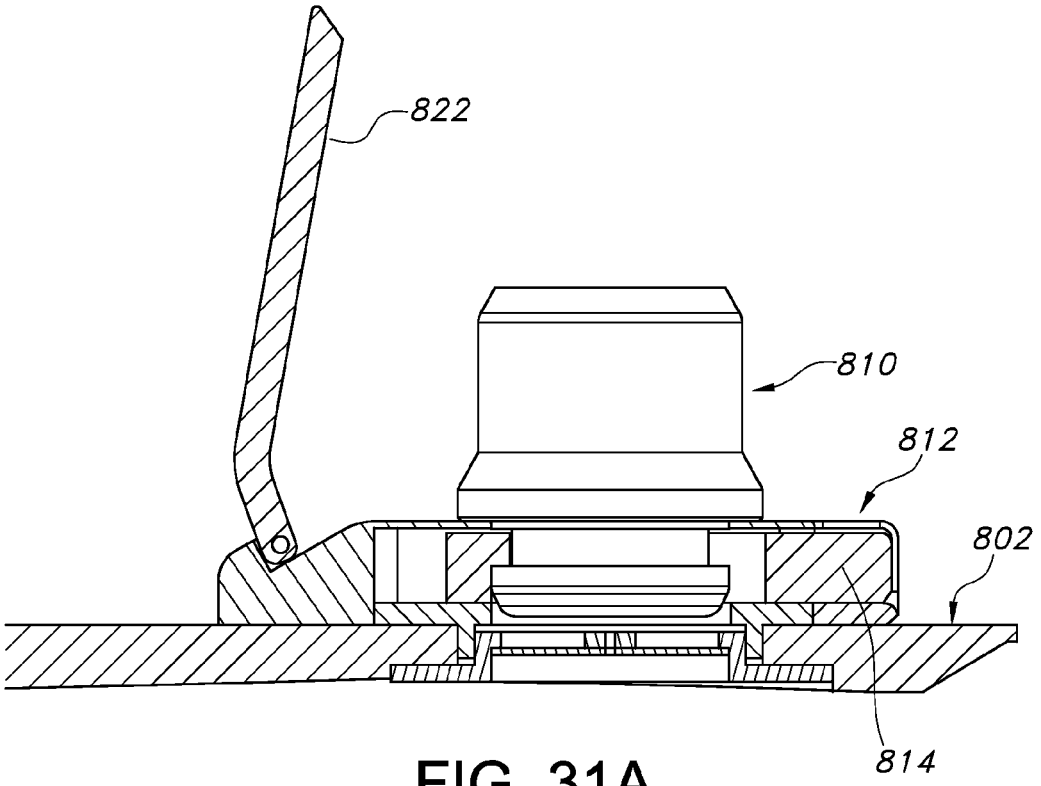
FIG. 31A shows a cross-sectional side view of the valve portion of the patient transfer device illustrated in FIG. 27, in an open position with an air supply line attached.

FIG. 31A shows a cross-sectional side view of the valve portion of the patient transfer device illustrated in FIG. 27, in an open position with an air supply line attached. FIG. 31A illustrates the hose coupling 810 in a latched configuration in which the latch 814 captures a shoulder of the hose coupling 810. As illustrated in FIG. 31A, movement of the latch 814 from the left toward the right provides such engagement. The latch 814 may be biased into the position shown in FIG. 31A by a spring or other mechanism. A cover 822 is shown in an open position, thereby providing access for engaging the hose coupling 810 with the patient support 802.

Figure 31B:
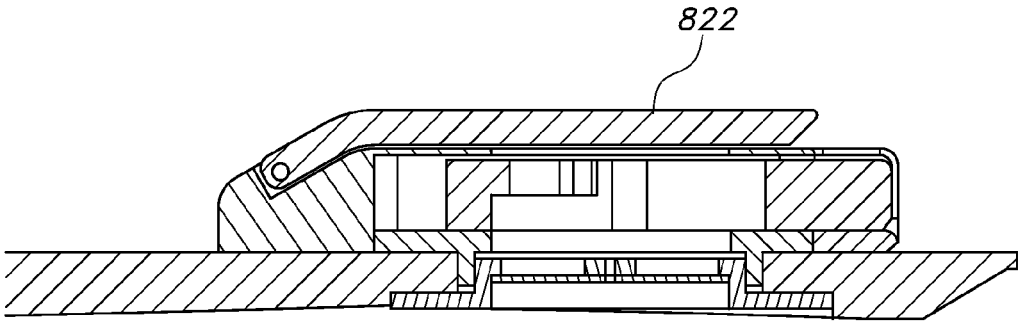
FIG. 31B shows a cross-sectional side view of the valve assembly shown in FIG. 31A, with the valve cover in a closed position.

FIG. 31B shows a cross-sectional side view of the valve assembly shown in FIG. 31A, with the valve cover in a closed position. In FIG. 31B, the cover 822 is shown in a closed position. This position protects the latch 814 and also prevents contamination or dirt from entering into the area of the valve 806.

Figure 32:
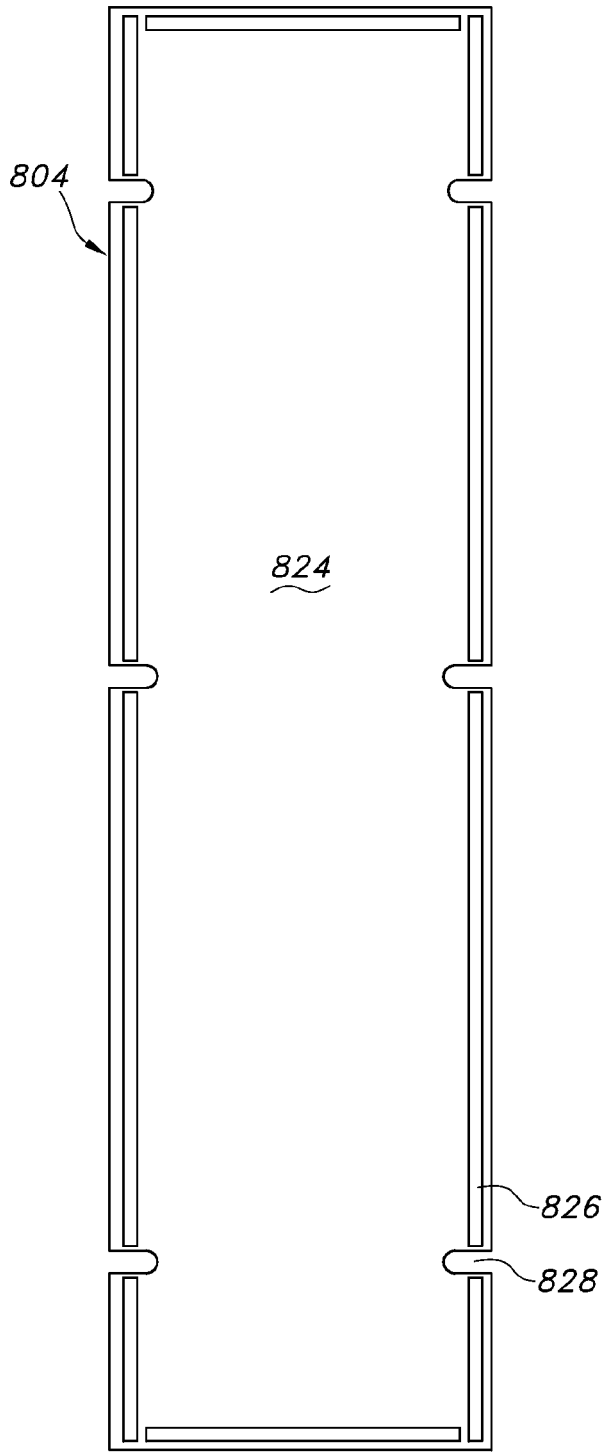
FIG. 32 shows a plan view of a top side of a bladder of the patient transfer device illustrated in FIG. 27.

FIG. 32 shows a plan view of a top side of a bladder of the patient transfer device illustrated in FIG. 27. FIG. 32 shows the top cover layer 824 of the bladder 804 of the patient support 802. The top cover layer 824 is provided with notches 828 that can be used for positioning or indexing purposes. Top cover layer 824 is also provided with a fastening mechanism such as hook and loop fasteners 826 that extend around the perimeter. More specifically, a fastener such as fasteners 826 extend around the outer perimeter of the top cover layer 824 to facilitate coupling, preferably releasable coupling, of the top cover layer 824 of the bladder 804 to the patient support 802.

Figure 33:
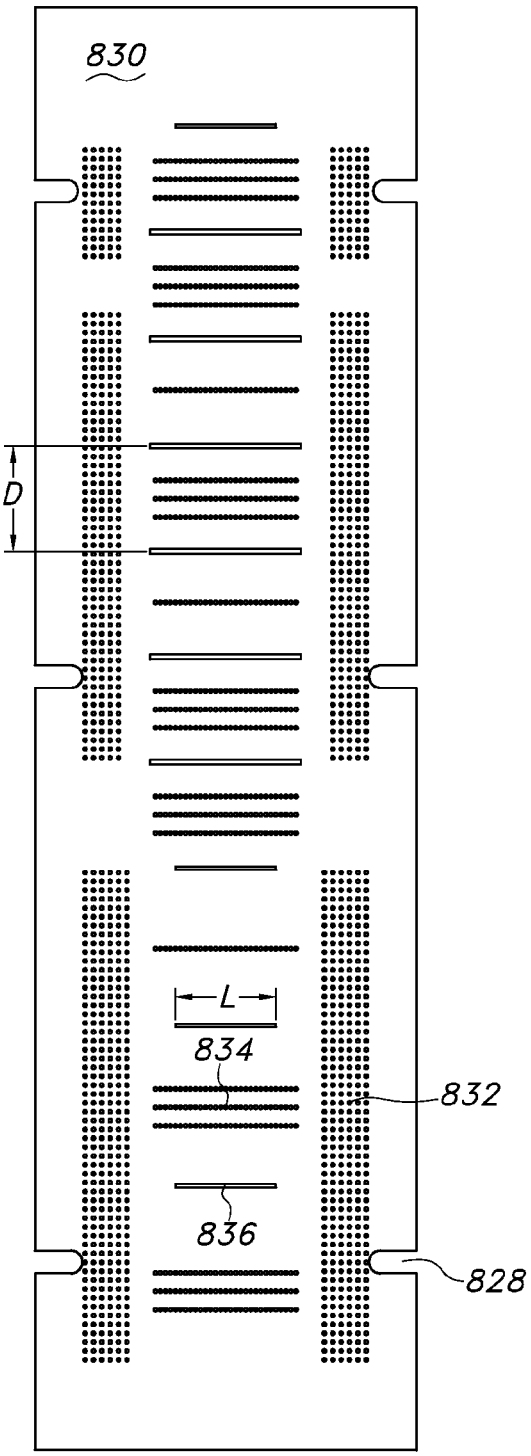
FIG. 33 shows a bottom plan view of the bladder illustrated in FIG. 32.

FIG. 33 shows a bottom plan view of the bladder illustrated in FIG. 32. FIG. 33 shows the bottom cover layer 830 of the bladder 804. Like the top cover layer 824, bottom cover layer 830 has notches 828. Bottom cover layer 830 also includes aperture groups 832 that are positioned generally to extend along the longitudinal direction of the bottom cover layer 830 along its sides. These aperture groups 832 include apertures through which air passes in order to provide an air bearing. The bottom cover layer 830 also includes a number of aperture lines 834 that extend generally in the width-wise direction. Finally, the bottom cover layer 830 includes a series of weld or bond lines 836 that also extend laterally along the width direction.

The weld or bond lines 836, aperture lines 834, and aperture groups 832 are positioned in such a way that the patient transfer device 800 can be moved from one surface to another while providing a substantial air bearing even when the patient transfer device passes over gaps between modalities or other openings through which air can escape. In other words, the apertures in the bottom cover layer 830 are positioned to provide the air bearing necessary to reduce friction between the patient transfer device and the support surface of the modalities such as trolley 801.

The weld or bond lines 836 are positioned along the length of the bladder in such a way as to provide controlled resistance to the passage of air through the bladder. By selecting the length of the weld or bond lines 836 and the distance between the weld lines, the resistance to air flow can be varied such that air flow can be redirected, depending on the location along the bladder 804. The weld and bond lines also restrain the bag in its inflated state, producing geometry that greatly improves stability and maximizes the effect of the air bearing.

More specifically, weld or bonds lines 836 have a length L and are separated by a distance D. By increasing the length L of the weld or bond lines 836, greater resistance to airflow around the welds is created, thus resisting the flow of air from one end to the other along the length of the bladder 804. In other words, shorter weld or bond lines 836 permit more air flow around the weld as compared to longer weld or bond lines 836.

The distance D between weld lines is varied in order to control the inflation and height of the bladder 804 when air flow is traveling through the bladder's interior. For example, a smaller distance D results in less elevation of the bladder when inflated, while a greater distance D increases that elevation.

In FIG. 33, a patient's head would typically be positioned at one end or the other of the patient transfer device 800, and the orientation of the weld or bond lines 836, aperture lines 834, and aperture groups 832 would be selected accordingly. Also, the length L and distance D associated with the weld or bond lines 836 would be positioned in order to support various anatomies of a patient.

Figure 34A:
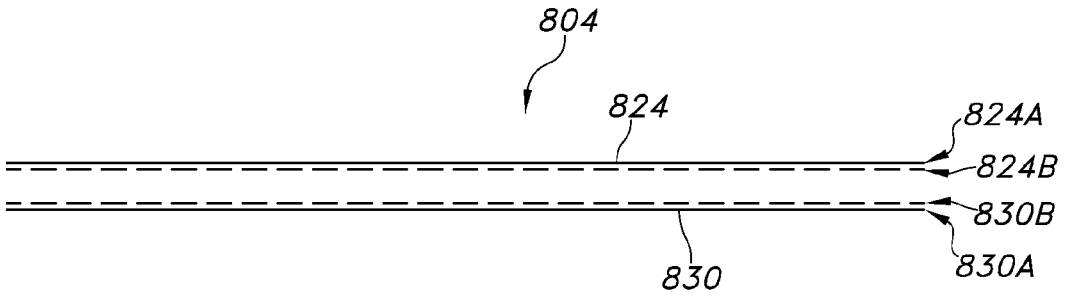
FIG. 34A-34C show cover layers of an embodiment of a bladder before, during, and after being welded, respectively, according to another aspect of this invention.
Figure 34B:
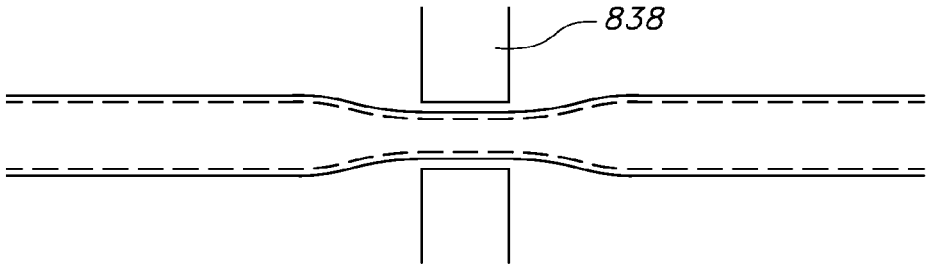
Figure 34C:
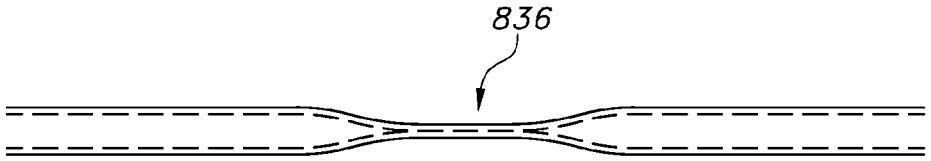

FIG. 34A-34C show cover layers of an embodiment of a bladder before, during, and after being welded, respectively, according to another aspect of this invention. FIG. 34A shows two layers of a bladder 804; namely, the top cover layer 824 and the bottom cover layer 830. These aspects of the bladder 804 are shown schematically. Each of the layers 824 and 830 includes several sublayers according to one embodiment of this invention. For example, top cover layer 824 includes an outer layer 824A and an inner layer 824B. Similarly, bottom cover layer 830 includes an inner layer 830B and an out outer layer 830A.

As shown in FIG. 34B, a weld bar 838 can be utilized according to one aspect of this invention in order to bond or otherwise connect the top cover layer 824 to the bottom cover layer 830. As illustrated in FIG. 34B, the layers are connected in such a way so that there is no other component in between them. In other words, in this embodiment, there is no baffle or wall extending from the bottom cover layer to the top cover layer. The resulting thickness of the bonded or welded bladder is simply the total thickness of the layers combined, approximately.

As shown in FIG. 34C, a weld or bond line 836 is provided as a result. The weld bar 838 shown in FIG. 34B can be maintained at a temperature sufficient to melt the inner layers 824B and 830B of the top cover layer 824 and 830, respectively, while not melting the outer layers 824A and 830A.

A wide variety of materials can be used for the inner and outer layers of the top and bottom cover layers.

Figure 35:
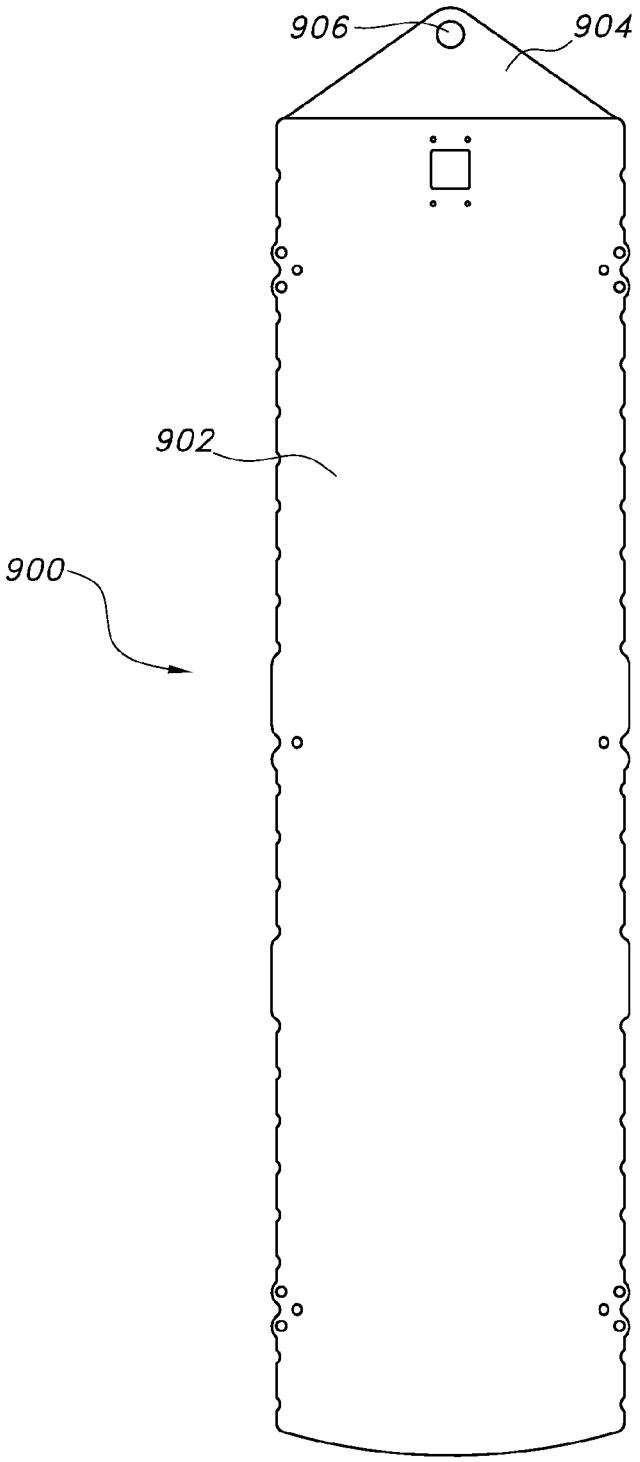
FIG. 35 illustrates yet another embodiment of a patient transfer device according to another aspect of this invention.
Figure 41:
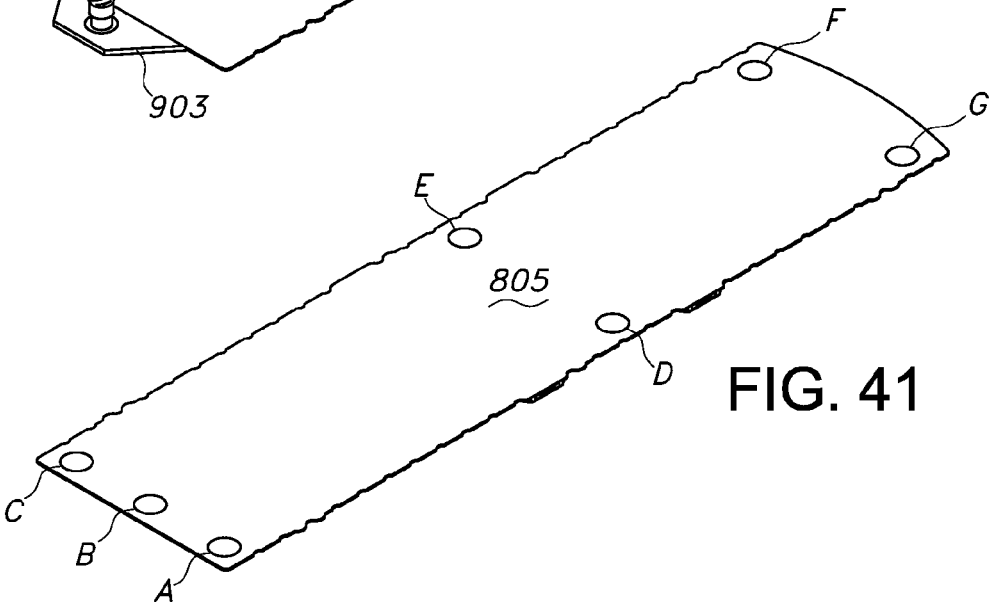
FIG. 41 is a top perspective view of an exemplary patient transfer device according to the present invention identifying possible attachment areas for an air supply line.

FIG. 35 shows yet another embodiment according to aspects of the invention, in which a patient support 902 and a bladder 904 are provided. Patient support 902 is similar to patient support 802. The bladder 904, however, differs from bladder 804 in that it is configured to have a portion extending beyond a perimeter of the patient support 902. In this way, a valve 906 can be provided on the bladder 904 at a location that is spaced away from the patient support 902. The air supply line may therefore be connected to an attachment point on the top surface 803 of a patient transfer device, as illustrated in FIG. 39, or directly to the bladder 903, as illustrated in FIG. 40. The attachment point for the air supply line may also be provided in one or more different locations (A-G) on the top surface 805 of a patient support surface and have various sized dimensions or shapes, as illustrated in FIG. 41. This provides additional flexibility for the handling of the air supply line and hose and the ability to accommodate different size hosing. While this extension of the bladder 904 is shown to extend from the head or foot end of the patient transfer device, it could also extend from the sides or from plural locations with multiple valves.

Figure 36:
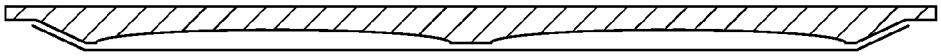
FIG. 36 shows a cross-sectional end view of yet another embodiment of a patient transfer device according to aspects of this invention.

FIG. 36 shows a cross-sectional end view of yet another embodiment of a patient transfer device according to aspects of this invention. FIG. 36 is an example of a patient transfer device that includes a bladder formed from a single cover layer connected to the patient support. In this embodiment, the bladder is defined by the bottom surface of the patient support and the cover layer. It also illustrates the manner in which a perimeter portion of the bladder is connected to beveled surfaces of the patient support.

As shown in FIG. 36, the patient support ideally has plural recesses extending along its length. With such a configuration, the central portion of the patient support can contact or bear against or be supported by a support surface, thereby supporting a central region of the patient support. Nevertheless, the recesses still provide access for air flow without pinching or otherwise obstructing the flow of air.

Although not shown, such longitudinal recesses communicate with one another by transverse recesses that may be positioned at any location along the length of the patient support. Also, the recesses can be provided in any variety of straight or curved or angled configurations.

Figure 37:
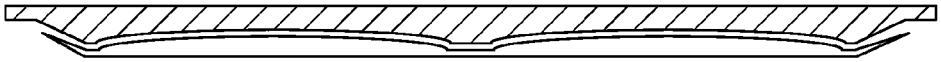
FIG. 37 illustrates a cross-sectional end view of still another embodiment of a patient transfer device.
Figure 38:
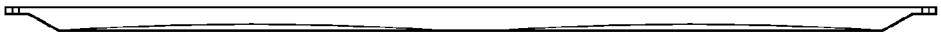
FIG. 38 is an end view of the patient transfer device of FIG. 36 having a bladder connected to its beveled perimeter

FIG. 37 illustrates a cross-sectional end view of still another embodiment of a patient transfer device. FIG. 37 illustrates an embodiment similar to that in FIG. 36 but with a bladder formed from two cover layers. In this view, the bladder is inflated at least partially so as to separate the cover layers (or sheet or skin) of the bladder. For example, the upper cover layer extends upwardly into the recesses and against the bottom surface of the patient support. The lower cover layer is spaced from the upper cover layer, thereby defining a passage for the flow of air. As can be seen in FIG. 37, the air flow passage is facilitated this way. Also, the cover layers of the bladder may be connected or coupled or otherwise sealed at their perimeter and then may be releasably or even permanently attached to the patient support at the beveled region as shown in FIG. 38.

Figure 45:
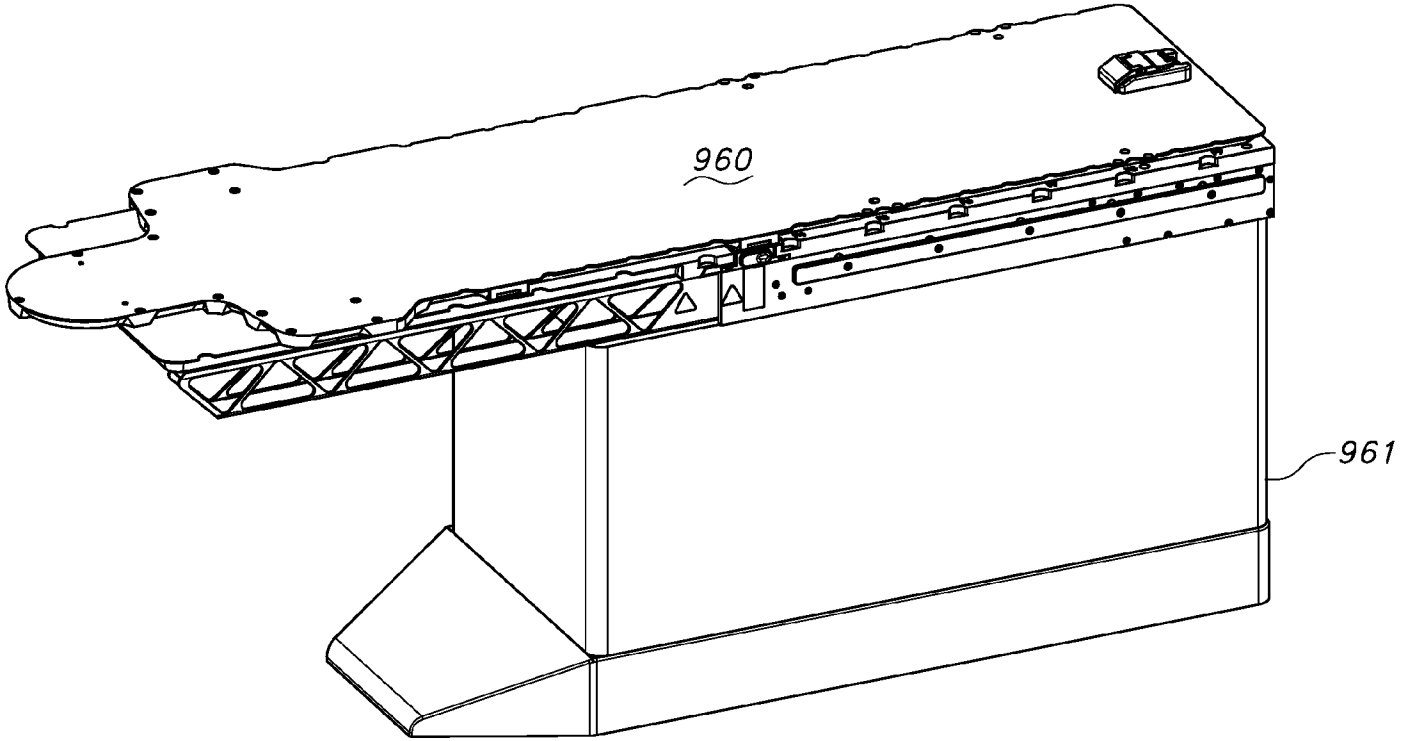
FIG. 45 is a top perspective view of a patient transfer device according to another embodiment of the present invention and a target modality.
Figure 46:
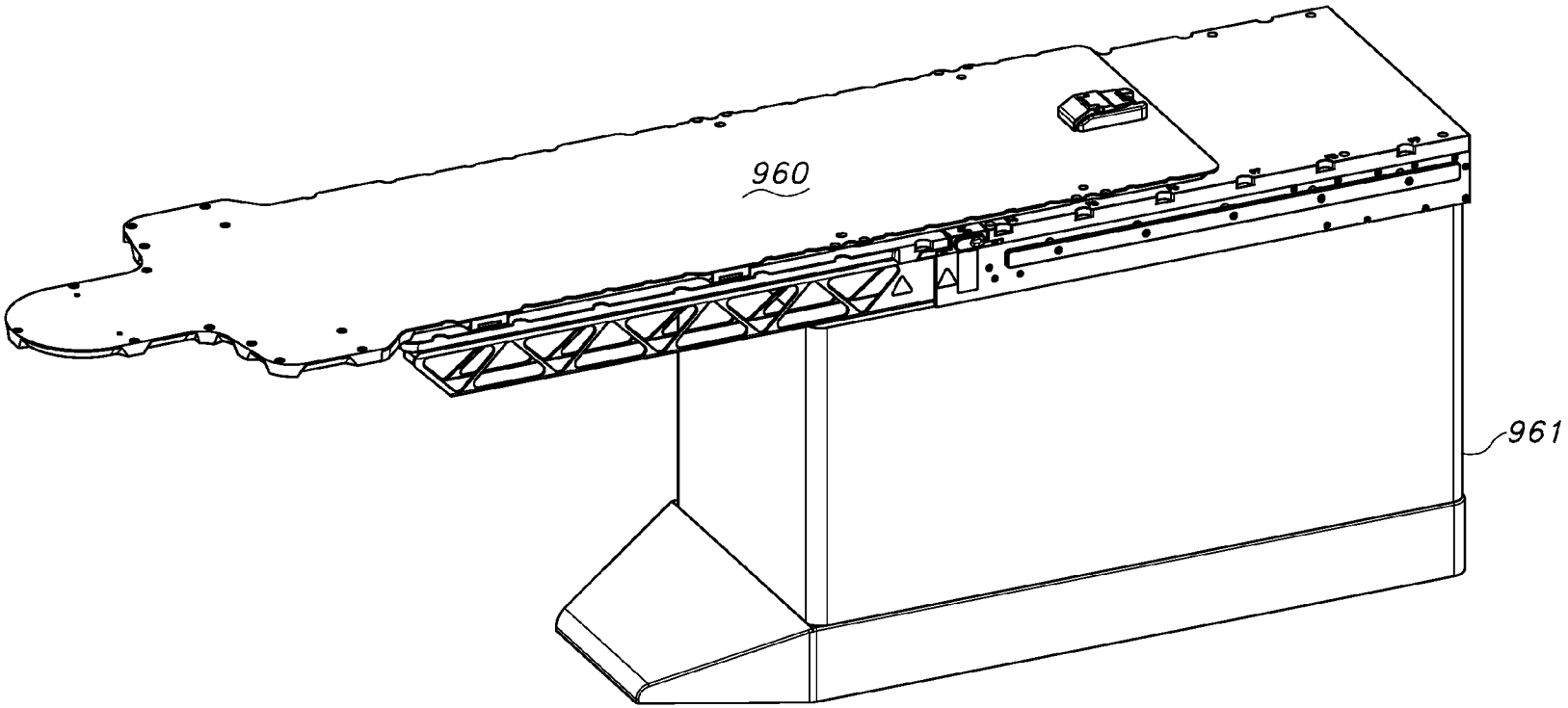
FIG. 46 is a top perspective view of the patient transfer device of FIG. 45 extending partially over the edge of the target modality.
Figure 47:
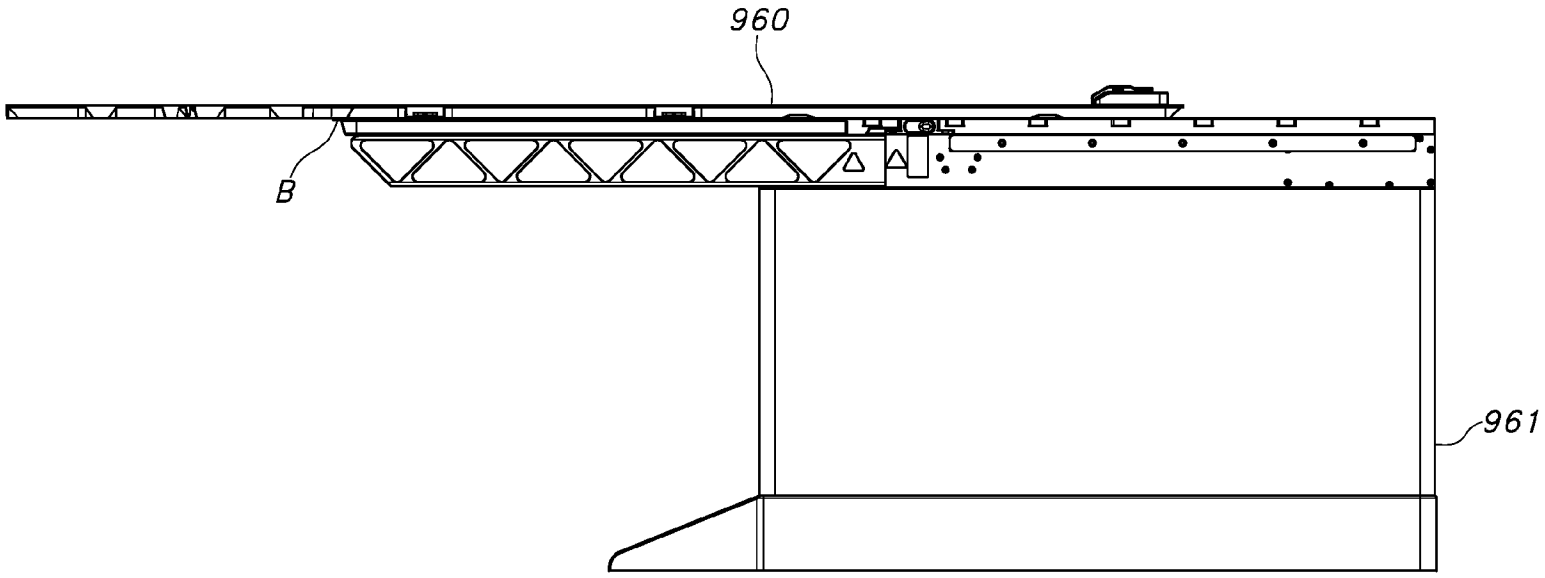
FIG. 47 is a side view of the patient transfer device and target modality of FIG. 46.

In one aspect of the present invention, the sculpted feature may mitigate the potential for the air bearing air passage from becoming pinched off. When the bottom surface of the transfer surface is flat, the air passage can become substantially constricted such that, upon starting delivery of air, it can never properly inflate. This prevents the transfer device from being able to lift the patient. The sculpted feature provides a low resistance channel through which air can always travel to initiate function of the air bearing. This feature also allows the transfer device to be able to be partially extended off an edge of the target modality patient table. For example, referring to FIGS. 45 and 46, a patient transfer device 960 according to one embodiment of the present invention is shown on the target surface of a modality 961. Certain medical treatments or therapy may require the patient transfer device 960 to be inflated and moved in a longitudinal direction, such that the patient transfer device 960 partially extends over an edge of the modality 961. Once extended, the air source may be turned off, the medical procedure or therapy may be performed on the patient, and the air source can be turned on again such the patient transfer surface 961 may be moved to a new position. Without the sculpted feature, the air passage would likely pinch off, for example, at location B in FIG. 47.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

The invention claimed is:

1. A patient transfer device comprising:

a patient support having a top surface configured to support a patient and a bottom surface configured to face a support surface, the bottom surface having at least one concave contour inwardly directed toward the top surface of the patient support; and a bladder positioned adjacent the bottom surface of the patient support and extending across a substantial portion of the bottom surface of the patient support, the bladder also extending across the at least one concave contour of the bottom surface of the patient support;

wherein passage of air flow into the bladder creates an air bearing under the patient support, the air bearing reducing friction between the patient support and the support surface, thereby facilitating transport of the patient transfer device when supporting the patient on the top surface of the patient support.

2. The patient transfer device according to claim 1, wherein the bladder has substantially no side walls.

3. The patient transfer device according to claim 1, wherein the bladder is substantially flat when not inflated.

4. The patient transfer device according to claim 1, wherein the bladder has a thickness that is about equal to the combined thicknesses of the layers when not inflated.

5. The patient transfer device according to claim 1, wherein the bladder comprises a top layer of material and a bottom layer of material, the top and bottom layers of material together at least partially defining an interior region for receiving the air flow.

6. A patient transfer device configured for movement relative to a receiving surface, the patient transfer device comprising:

a patient support having a bottom surface configured to face the receiving surface, the bottom surface having at least one proximal region configured to be positioned proximal to the receiving surface when the patient transfer device contacts the receiving surface and at least one spaced region configured to be spaced from the receiving surface when the patient transfer device contacts the receiving surface, a passageway defined between the bottom surface and the receiving surface at the at least one spaced region when the patient transfer device contacts the receiving surface, and a cover extending over at least a portion of the at least one spaced region so as to be interposed between the bottom surface of the patient support and the receiving surface when the patient transfer device contacts the receiving surface, and the cover extending across and covering a substantial portion of the bottom surface of the patient support, and the cover defining at least one aperture for air flow;

wherein the cover provides an air bearing when air is being delivered into the passageway, and the passageway is maintained when the air is not being delivered into the passageway; and wherein the at least one spaced region of the bottom surface of the patient support is defined by a concave contour inwardly directed toward a top surface of the patient support, the concave contour maintaining the passageway defined between the bottom surface of the patient support and the receiving surface at the at least one spaced region when the patient transfer device contacts the receiving surface.

7. The patient transfer device according to claim 6, wherein the cover is flexible.

8. The patient transfer device according to claim 6, wherein the cover is removable from the patient support.

9. The patient transfer device according to claim 6, wherein the passageway is configured to prevent pinching off of the passageway.

10. The patient transfer device according to claim 6, wherein the patient support is rigid when air is not delivered to the passageway and wherein the patient transfer device is configured to slide and extend off of a portion of the receiving surface and retract back onto the receiving surface when air is delivered to the passageway.

11. The patient transfer device according to claim 6, wherein the concave contour is at least partially formed by at least one spacer positioned to space the at least one spaced region of the bottom surface of the patient support from the receiving surface when the patient transfer device contacts the receiving surface.

12. The patient transfer device according to claim 11, wherein the cover extends over the at least one spacer such that the cover is interposed between the at least one spacer and the receiving surface when the patient transfer device contacts the receiving surface.

13. The patient transfer device according to claim 11, wherein the cover is positioned such that the at least one spacer contacts the receiving surface when the patient transfer device contacts the receiving surface.

14. The patient transfer device according to claim 11, wherein the cover includes two cover layers together defining a bladder for receiving the air flow.

* * * * *